US011518172B2

(12) United States Patent
Kasai

(10) Patent No.: US 11,518,172 B2
(45) Date of Patent: Dec. 6, 2022

(54) CLEANING METHOD OF LIQUID EJECTION HEAD, CONTROL METHOD OF THE SAME, AND A LIQUID EJECTION DEVICE

(71) Applicant: CANON KABUSHIKI KAISHA, Tokyo (JP)

(72) Inventor: Shintaro Kasai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/343,588

(22) Filed: Jun. 9, 2021

(65) Prior Publication Data

US 2021/0387456 A1 Dec. 16, 2021

(30) Foreign Application Priority Data

Jun. 15, 2020 (JP) ..... JP2020-103054
Feb. 25, 2021 (JP) ..... JP2021-029159

(51) Int. Cl.
*B41J 2/165* (2006.01)
*B41J 2/21* (2006.01)

(52) U.S. Cl.
CPC ..... *B41J 2/16585* (2013.01); *B41J 2/16538* (2013.01); *B41J 2/16541* (2013.01); *B41J 2/16547* (2013.01); *B41J 2/2103* (2013.01)

(58) Field of Classification Search
CPC ..... B41J 2/16585; B41J 2/16538; B41J 2/16541; B41J 2/16547; B41J 2/2103
See application file for complete search history.

(56) References Cited

U.S. PATENT DOCUMENTS

2006/0244799 A1* 11/2006 Sasa ..... B41J 2/17509 347/89

FOREIGN PATENT DOCUMENTS

| | | | |
|---|---|---|---|
| JP | H02202453 | A | 8/1990 |
| JP | 2014510649 | A | 5/2014 |
| WO | 2012091867 | A2 | 7/2012 |

* cited by examiner

*Primary Examiner* — Justin Seo
(74) *Attorney, Agent, or Firm* — Canon U.S.A., Inc. I.P. Division

(57) ABSTRACT

A cleaning method of a liquid ejection head where recording element substrates having an ejection orifice forming-face having ejection orifice arrays which are aligned, and at least one array ejects a different recording liquid than another, includes wiping and preliminary ejection. In the wiping, a wiping member is caused to move along and wipe the arrays. In the preliminary ejection, before the wiping of the entire ejection orifice forming-face is completed, preliminary ejection from the wiped ejection orifices is started. The wiping and preliminary ejection are sequentially performed from a recording element substrate at one end to a recording element substrate at the other end.

17 Claims, 16 Drawing Sheets

CLEANING METHOD OF LIQUID EJECTION HEAD, CONTROL METHOD OF THE SAME, AND A LIQUID EJECTION DEVICE

BACKGROUND

Field of the Disclosure

The present disclosure relates to a cleaning method of a liquid ejection head, a control method of the same, and a liquid ejection device.

Description of the Related Art

In an ink-jet recording device that is a type of a liquid ejection device, a recording liquid in which a solid component such as a coloring material is added to a volatile component that is a solvent is ejected to the outside from ejection orifices of a liquid ejection head to perform recording. If the volatile component of a recording liquid in contact with the outside air via the ejection orifices volatilizes (evaporates) and the viscosity of the recording liquid located near the ejection orifices increases, an ejection characteristic of the recording liquid, for example, landing accuracy of a liquid droplet to a recording medium decreases, and this may cause a reduction in recording quality. In particular, recording liquids, containing a greater amount of solid components, that have been used in recent years in commercial printing or the like for making an album, for example, may cause a greater increase in viscosity (thickening) of such a recording liquid due to volatilization of a volatile component and may be unable to maintain accuracy in ejection of the recording liquid (may cause a liquid ejection failure). As an example of a method of suppressing such thickening of a recording liquid, Japanese Patent Application Laid-Open No. 2014-510649 proposes a method of circulating a recording liquid through an ejection orifice or a pressure chamber and refreshing the recording liquid all the time without retaining the recording liquid in the ejection orifice or the pressure chamber.

Further, Japanese Patent Application Laid-Open No. H02-202453 proposes various methods of wiping an ejection orifice forming-face in order to remove a recording liquid attached to the ejection orifice forming-face of a liquid ejection head to improve ejection characteristics. For example, proposed is a method of wiping the ejection orifice forming-face with a flexible plate-like member (rubber blade or the like), a method of sucking a recording liquid while wiping off the recording liquid with a flexible tube-like member, a method of wiping off the recording liquid with a sponge-like porous material or nonwoven fabric, and a method of pressing a porous material or nonwoven fabric and sucking the recording liquid by capillary force. These methods are called a blade wipe method, a vacuum wipe method, a wave wipe method, and a tack method, respectively. However, when the wiping described above is performed on a multicolor-integrated head in which liquid ejection heads that eject different colors or different types of recording liquids are integrally formed, a phenomenon that different colors (types) of recording liquids are mixed on the ejection orifice forming-face (color mixture) may occur. If a color-mixed recording liquid caused by wiping is pushed into the pressure chamber from the ejection orifices, it is no longer possible to perform recording with a desired color. Thus, before recording is performed after wiping, liquid ejection (preliminary ejection) not involved in recording is performed in order to discharge a color-mixed recording liquid to the outside.

If wiping is performed in a state where a recording liquid is circulated through an ejection orifice or a pressure chamber as with the method disclosed in Japanese Patent Application Laid-Open No. 2014-510649, a color-mixed recording liquid pushed into the ejection orifices or the pressure chambers by the wiping will be circulated. Since this causes the color-mixed recording liquid to spread in the entire channel in the liquid ejection head, the color-mixed recording liquid is unable to be fully discharged even if preliminary ejection is performed as with the method disclosed in Japanese Patent Application Laid-Open No. H02-202453. Thus, recording with a desired color can no longer be performed, and this causes a significant reduction in recording quality. To prevent such a situation, one conceivable way is to stop circulation of a recording liquid during wiping and resume the circulation of the recording liquid after wiping and preliminary ejection for the entire ejection orifice forming-face of the liquid ejection head are completed. However, the volatile component of the recording liquid near the ejection orifices volatilizes even in a short time after wiping is performed before preliminary ejection is started, and the color-mixed recording liquid is thickened by the wiping. The thickened recording liquid makes it difficult to eject the color-mixed recording liquid by preliminary ejection. In particular, in a line type head in which the recording width of a liquid ejection head has substantially the same length as the recording width of the recording medium, it takes a long time from the start of wiping to completion of the wiping. If the circulation of the recording liquid is stopped during such wiping, thickening of the recording liquid inside the ejection orifices or the pressure chambers proceeds in a portion initially wiped, at the start of wiping in particular, and this may make it difficult to eject the recording liquid during preliminary ejection. In such a case, to remove the thickened recording liquid from the pressure chambers, it is required to take a countermeasure to increase the number of ejection times in preliminary ejection, increase the duration of circulation of the recording liquid resumed after preliminary ejection, or the like, for example. Such a countermeasure consumes a greater amount of recording liquid which does not contribute to recording, and increases the time required for maintenance after the stopping of circulation of the recording liquid to the resumption of the circulation through wiping and preliminary ejection.

SUMMARY

The present disclosure generally provides a cleaning method and a control method of a liquid ejection head and provides a liquid ejection device that consumes less recording liquid for maintenance, can remove a thickened recording liquid from pressure chambers, and can suppress color mixture, an ejection failure, or a reduction in recording quality. Furthermore, the present disclosure includes a cleaning method and a control method of a liquid ejection head and provides a liquid ejection device that can complete maintenance, which stops circulation of a recording liquid, in a short time and promptly resumes a recording operation.

An aspect of the present disclosure is a cleaning method of a liquid ejection head in which a plurality of recording element substrates are aligned, each of the recording element substrates has an ejection orifice forming-face in which a plurality of ejection orifice arrays are formed, each of the ejection orifice arrays comprises a plurality of ejection orifices, and at least one of the ejection orifice arrays ejects a different recording liquid than another one of the ejection orifice arrays, and the cleaning method includes: a wiping step of performing wiping to wipe the ejection orifice forming-face; and a preliminary ejection step of performing preliminary ejection of the recording liquid from the wiped ejection orifices. In the wiping step, a wiping member is moved along the ejection orifice arrays to wipe the plurality of ejection orifice arrays with the wiping member. In the preliminary ejection step, before wiping the entire ejection orifice forming-face is completed, preliminary ejection from the wiped ejection orifices is started. The wiping step and the preliminary ejection step are sequentially performed from a recording element substrate located at one end to a recording element substrate located at the other end of an array of the recording element substrates.

Further features of the present disclosure will become apparent from the following description of exemplary embodiments with reference to the attached drawings.

DESCRIPTION OF THE EMBODIMENTS

Embodiments of the present disclosure will be described below with reference to the drawings. However, the following description is not intended to limit the scope of the present disclosure. Examples described below are directed to a liquid ejection head of a thermal system using a heat generation element as an energy-generating element (recording element) that generates energy for ejecting a recording liquid. In the liquid ejection head of the thermal system, thermal energy is generated to cause a bubble to occur in a recording liquid inside pressure chambers, and the recording liquid is ejected from ejection orifices. However, the liquid ejection head to which the present disclosure is applicable is not limited to those of the thermal system, the present disclosure can be applied to liquid ejection heads employing a piezo system using a piezoelectric element or other various liquid ejection systems.

First Embodiment (Ink-Jet Recording Device)

Figure 1:
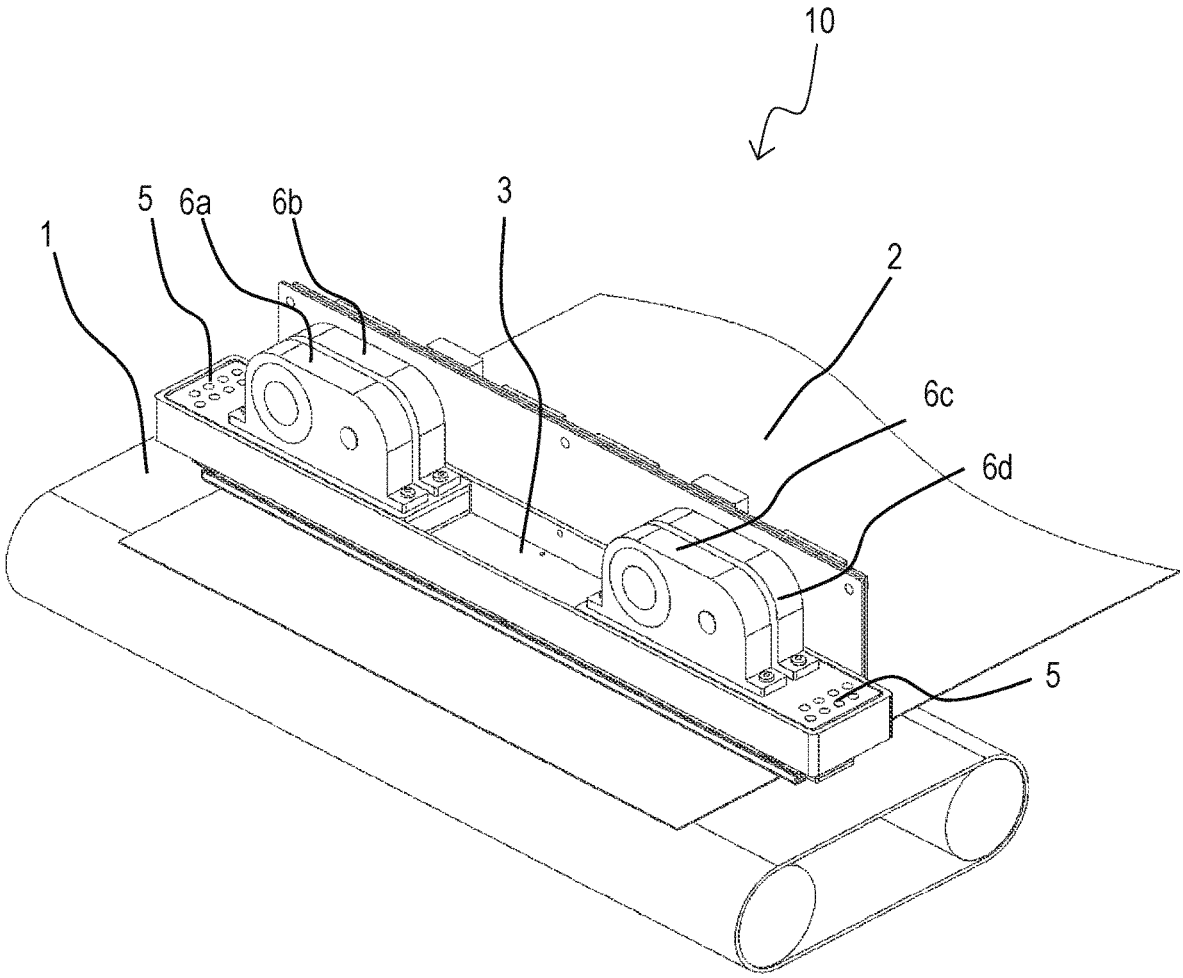
FIG. 1 is a schematic perspective view illustrating a main part of a liquid ejection device including a liquid ejection head to which a cleaning method of the present disclosure is applied.
Figure 2:
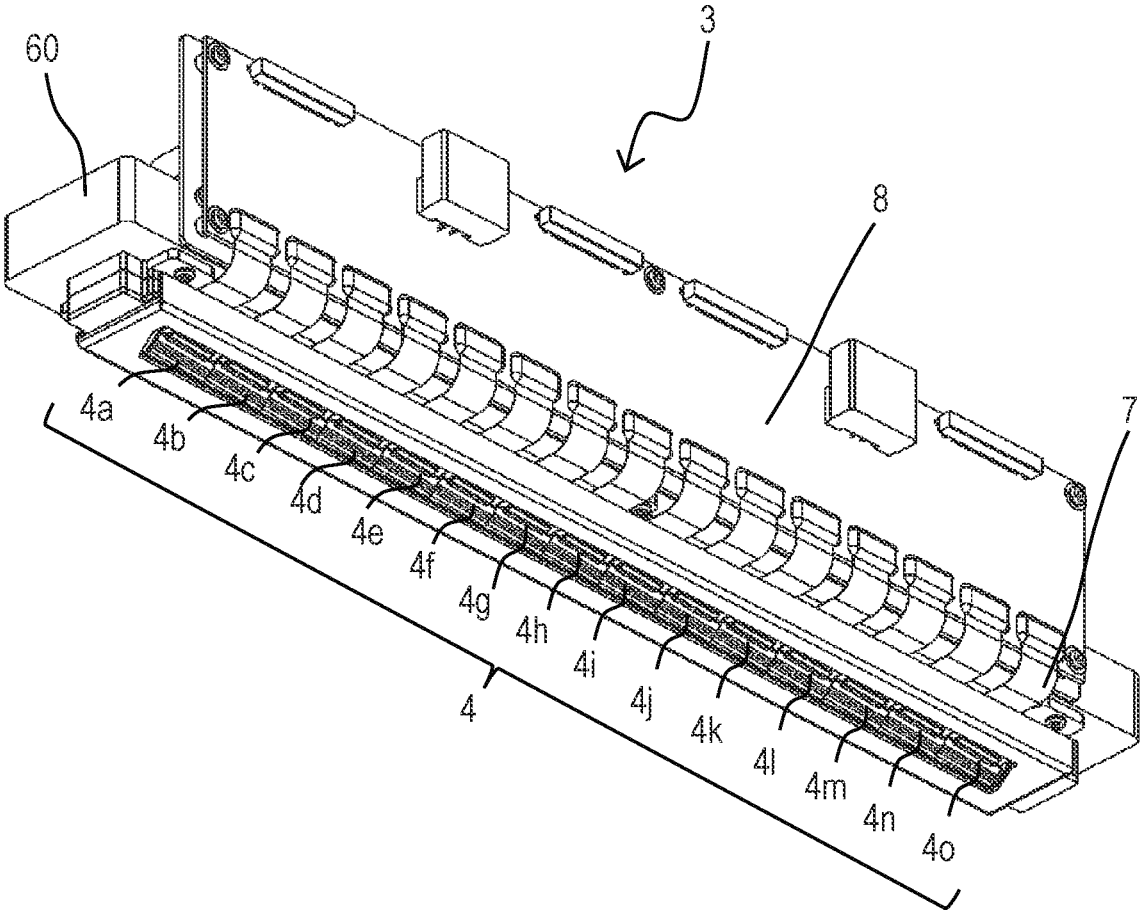
FIG. 2 is a schematic perspective view of the liquid ejection head of the liquid ejection device illustrated in FIG. 1 when viewed from an ejection orifice forming-face side.

FIG. 1 is a schematic perspective view illustrating some of the components related to recording performed by an ink-jet recording device 10 (hereafter, also referred to as a recording device) that ejects liquid ink to perform recording, which is an example of the liquid ejection device to which the present disclosure is applied. FIG. 2 is a schematic perspective view of a liquid ejection head 3 of the recording device 10 illustrated in FIG. 1. The recording device 10 has a conveyance unit 1 that conveys a recording medium 2, the liquid ejection head 3 having recording element substrates 4 illustrated in FIG. 2, a liquid supply mechanism described later, a cleaning mechanism 30 of the liquid ejection head 3 (see FIG. 5), an outer casing (not illustrated), a control mechanism 50 (see FIG. 16), and the like. The liquid ejection head 3 is a line type liquid ejection head 3 in which a plurality of recording element substrates 4 are aligned on a support member 60 in a direction substantially orthogonal to a conveying direction of the recording medium 2 (see FIG. 1) over substantially the same distance as the recording width of the recording medium 2 as illustrated in FIG. 2. A wiring board (not illustrated) that transfers electrical power and an ejection control signal is electrically connected to the liquid ejection head 3. The liquid supply mechanism is a mechanism in which a liquid supply member serving as a supply path (not illustrated) to supply a recording liquid (liquid ink) to the liquid ejection head 3, a main tank (not illustrated), and a buffer tank (not illustrated) are fluidly connected to each other. The liquid path in the liquid ejection head 3 to which a recording liquid is supplied from the liquid supply mechanism will be described later. The control mechanism 50 controls driving of the liquid ejection head 3, driving of respective members of the conveyance unit 1, driving of the cleaning mechanism 30, and the like. The recording device 10 causes these components to cooperate with each other and performs one-path continuous recording while continuously or intermittently conveying a plurality of recording media 2. Note that the recording medium 2 is not limited to a cut sheet but may be a continuous roll sheet. The liquid ejection head 3 of the present embodiment can perform full-color printing using cyan (C) ink, magenta (M) ink, yellow (Y) ink, and black (K) ink as recording liquids.

As illustrated in FIG. 1, each of liquid connection portions 5 provided at both ends of the liquid ejection head 3 is a portion that connects supply paths of the recording device body (not illustrated) and liquid paths of the liquid ejection head 3 to each other. Accordingly, each of four colors of C, M, Y, and K ink is supplied from the supply path of the recording device body to the liquid ejection head 3, and the ink that has passed through the liquid path in the liquid ejection head 3 is collected into the supply path of the recording device body. In such a way, each color of ink is circulated through the supply path of the recording device body and the liquid path of the liquid ejection head 3 (during the circulation, the supply pressure is adjusted by pressure adjustment mechanisms 6*a*, 6*b*, 6*c*, and 6*d* provided to the head).

(Configuration of Liquid Ejection Head)

The configuration of the liquid ejection head 3 according to the first embodiment of the present disclosure will be described below. FIG. 2 is a schematic perspective view of the liquid ejection head 3 according to the present embodiment. The liquid ejection head 3 according to the present embodiment is a line type liquid ejection head in which 15 recording element substrates 4 each alone capable of ejecting four colors of C, M, Y, and K liquid ink are aligned in a straight line. That is, 15 recording element substrates 4*a* to 4*o* are arranged inline. Note that expansion of the recording width can be achieved by increasing the number of recording element substrates 4. As illustrated in FIG. 2, the liquid ejection head 3 has an electrical wiring board 8 electrically connected to the wiring board of the recording device body (not illustrated) via a flexible wiring board 7 in addition to the recording element substrates 4*a* to 4*o*.

(Configuration of Recording Element Substrate)

Figure 3:
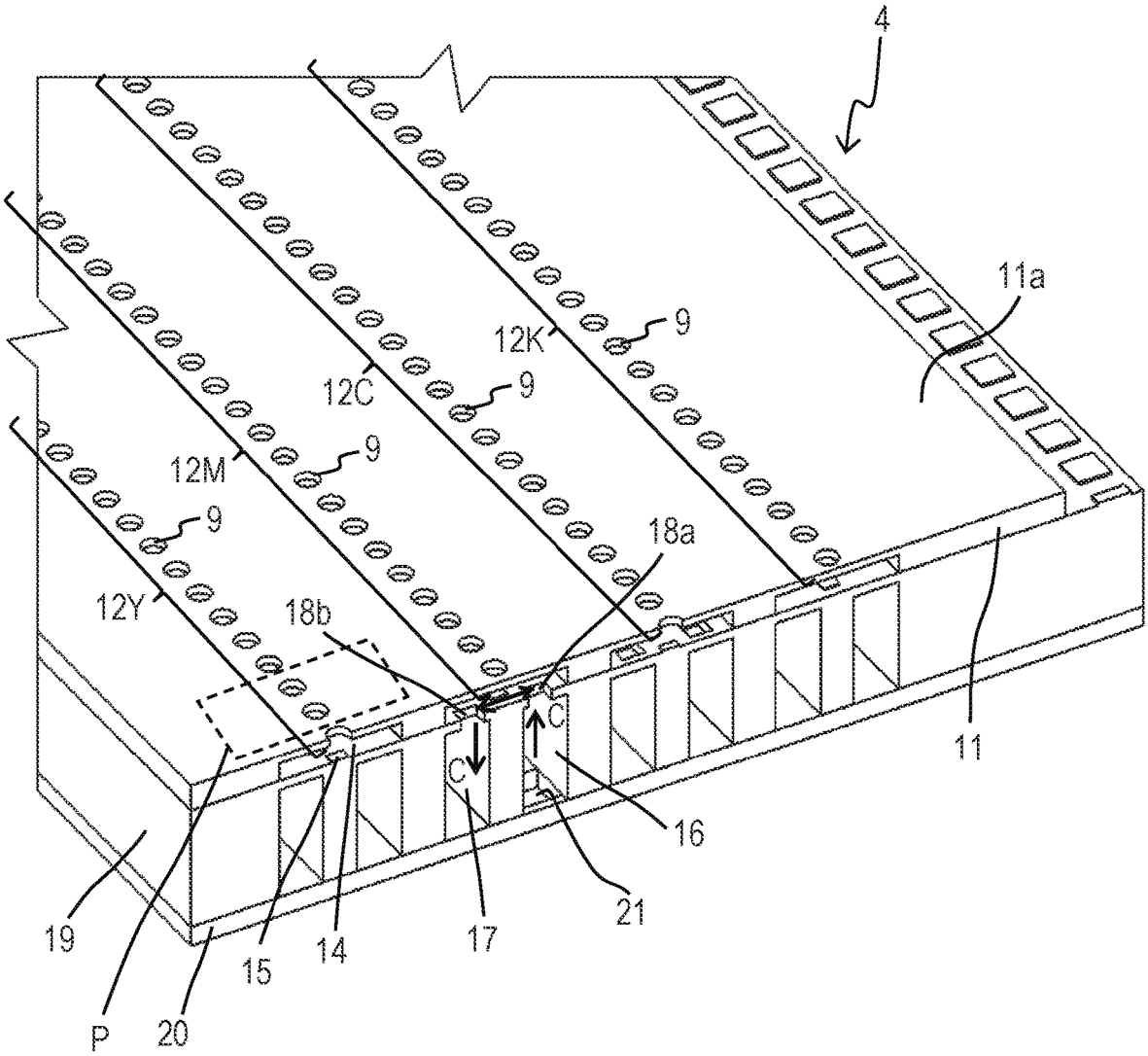
FIG. 3 is a schematic perspective view illustrating a partially cut recording element substrate of the liquid ejection head illustrated in FIG. 2.
Figure 4A:
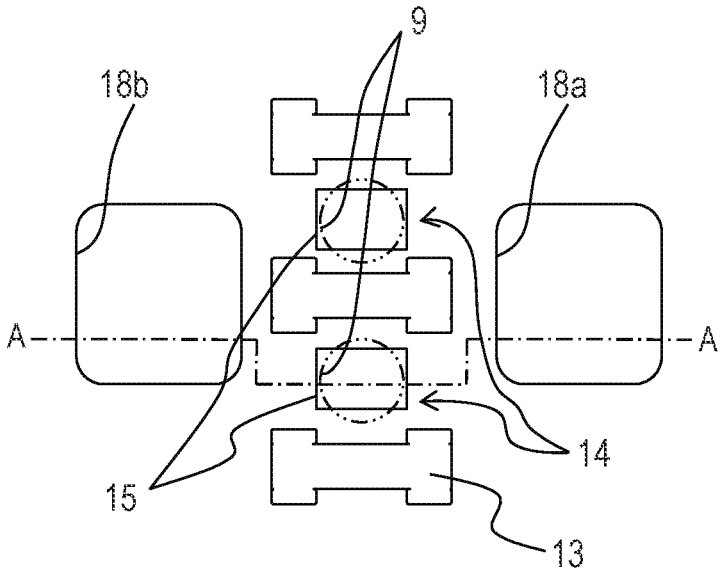
FIG. 4A is a schematic plan view of a main part of the liquid ejection head illustrated in FIG. 2 and FIG. 3.
Figure 4B:
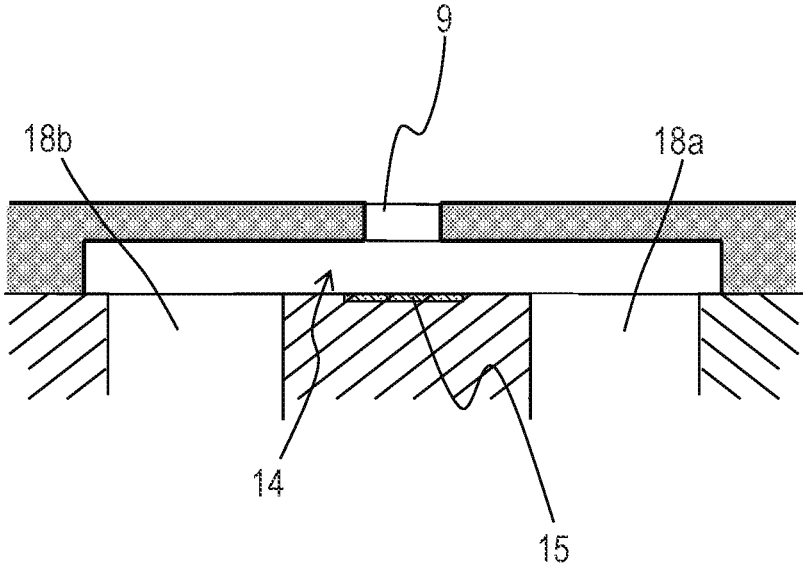
FIG. 4B is a sectional view taken along a line A-A of FIG. 4A.

The configuration of each recording element substrate 4 of the present embodiment will be described. FIG. 3 is a schematic perspective view of the recording element substrate 4 when viewed from the side on which ejection orifices 9 are formed (ejection orifice forming-face 11*a* side), and a part of the recording element substrate 4 is cut out and illustrated. FIG. 4A is a schematic plan view in which the region P of FIG. 3 is enlarged and respective components are transparently overlapped. FIG. 4B is a schematic sectional view taken along a line A-A of FIG. 4A. The recording element substrate 4 is configured such that a substrate 19 made of Si and an ejection orifice forming-member 11 made of a photosensitive resin are stacked. As illustrated in FIG. 3, a plurality of ejection orifice arrays each formed of a plurality of ejection orifices 9 are formed on the ejection orifice forming-face 11*a* of the ejection orifice forming-member 11 of the recording element substrate 4. Specifically, in the present embodiment, four arrays of ejection orifice arrays 12M, 12C, 12Y, and 12K corresponding to four colors (M, C, Y, and K) of ink are formed. Note that, hereafter, a direction in which the ejection orifice array formed of the plurality of ejection orifices 9 extends is referred to as "ejection orifice alignment direction". In such a way, in the liquid ejection head 3, the plurality of recording element substrates 4 having the ejection orifice forming-face 11*a*, in which the plurality of ejection orifice arrays 12M, 12C, 12Y, and 12K each formed of the plurality of ejection orifices 9 are formed, are aligned in a line.

As illustrated in FIG. 4A, pressure chambers 14 partitioned by partition walls (channel walls) 13 are provided at positions corresponding to respective ejection orifices 9. As illustrated in FIG. 4B, a heat generation element (recording element) 15 that is an example of an energy-generating element that generates energy for ejecting a recording liquid is arranged at a position corresponding to each pressure chamber 14 of the substrate 19. The heat generation elements 15 are electrically connected to electrical wirings (not illustrated) provided to the recording element substrates 4. The heat generation element 15 generates thermal energy based on an ejection control signal (pulse signal) input from a control circuit of the recording device body (not illustrated) via the electrical wiring board 8 and the flexible wiring board 7 and causes a recording liquid to film-boil. The pressure due to this film boiling causes the recording liquid to be ejected from the ejection orifice 9 to the outside. As illustrated in FIG. 3, a liquid supply channel 16 is formed on one side viewed from each ejection orifice array, a liquid collection channel 17 is formed on the other side, and both of the channels extend along the ejection orifice array. The liquid supply channel 16 and the liquid collection channel 17 each are formed of a groove provided in a face of the substrate 19 opposed to the face on which the recording element 15 is formed and communicate with the pressure chambers 14 and the ejection orifices 9 via a supply port 18*a* and a collection port 18*b*, respectively. Pressure adjustment mechanisms 6*a* to 6*d* (see FIG. 1) that generate a differential pressure adjusted on a color basis are provided between the liquid supply channel 16 and the liquid collection channel 17.

As illustrated in FIG. 3, a cover plate 20 is stacked on a face forming the substrate 19 of the recording element substrate 4 and opposed to a face in contact with the ejection orifice forming-member 11. The cover plate 20 is provided with a plurality of openings 21 communicating with the liquid supply channel 16 and the liquid collection channel 17. The cover plate 20 of the present embodiment is provided with three openings 21 for one liquid supply channel 16 and two openings 21 for one liquid collection channel 17.

Next, the flow of a recording liquid inside each recording element substrate 4 will be described. A differential pressure adjusted on a color basis by any of the pressure adjustment mechanisms 6*a* to 6*d* (see FIG. 1) occurs between the liquid supply channel 16 and the liquid collection channel 17. While the recording liquid is being ejected from some of the ejection orifices 9 of the liquid ejection head 3, the recording liquid in the liquid supply channel 16 of the substrate 19 flows to the liquid collection channel 17 via the supply port 18*a*, the pressure chambers 14, and the collection port 18*b* in the ejection orifices 9 ejecting no recording liquid due to the differential pressure described previously. That is, the recording liquid flows in the C direction in FIG. 3. With this flow in the C direction, a recording liquid thickened by volatilization of a volatile component from the ejection orifices 9 or a bubble and a foreign material or the like can be collected to the liquid collection channel 17 in the ejection orifices 9 and the pressure chambers 14 ejecting no recording liquid. Since a refreshed recording liquid is supplied to the ejection orifices 9 and the pressure chambers 14 all the time, thickening of a recording liquid inside the ejection orifices 9 or the pressure chambers 14 can be suppressed. The recording liquid collected to the liquid collection channel 17 is eventually collected to the supply path of the recording device body through the openings 21 of the cover plate 20. Such a flow of a recording liquid is referred to as recording liquid circulation (circulation flow) in the present specification.

(Cleaning Mechanism)

Figure 5:
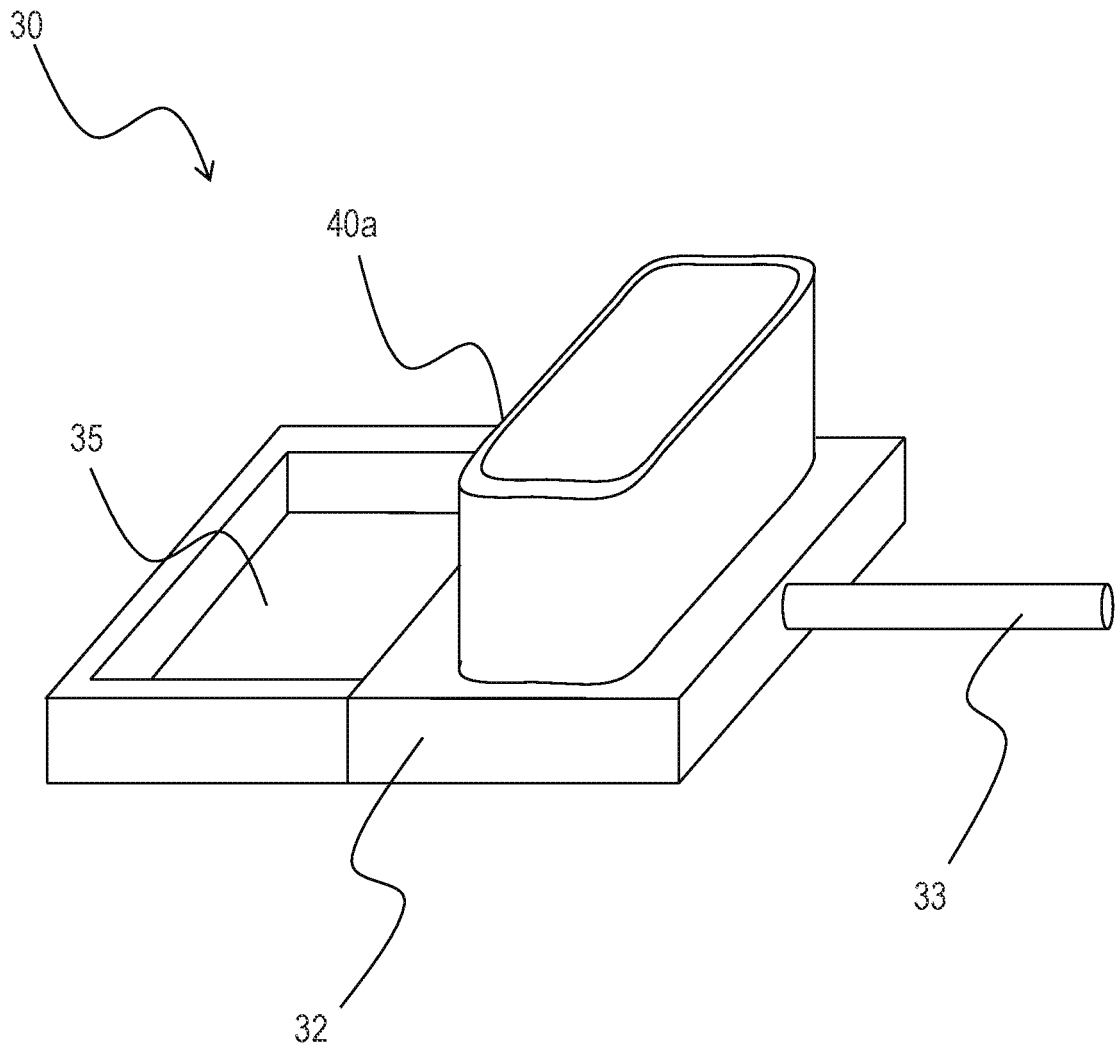
FIG. 5 is a schematic perspective view illustrating a cleaning mechanism of the liquid ejection device of a first embodiment of the present disclosure.

FIG. 5 illustrates the cleaning mechanism 30 that comes into contact with the ejection orifice forming-face 11*a* of the ejection orifice forming-member 11 of the recording element substrate 4 and cleans up the ejection orifice forming-face 11*a*. As illustrated in FIG. 5, the cleaning mechanism 30 has a base 32, an elastic tube 40*a* fixedly arranged to the base 32, a suction tube 33 coupled to the elastic tube 40*a*, and a preliminary ejection receiving part 35 arranged adjacent to the base 32. The elastic tube 40*a* can cover a plurality of ejection orifices 9 in the ejection orifice alignment direction and is formed to have a size to cover all the ejection orifice arrays 12M, 12C, 12Y, and 12K in the direction crossing the ejection orifice alignment direction. As a wiping step, the open end of the elastic tube 40*a* is pushed against the ejection orifice forming-face 11*a*, and the base 32 is moved in the ejection orifice alignment direction by a motion mechanism while a suction pump 34 (for example, see FIG. 6A) connected to the elastic tube 40*a* via the suction tube 33 is being operated. In such a way, the elastic tube 40*a* is slidably contacted with the entire region of the ejection orifice forming-face 11*a*, and suction and wiping are performed at the same time. This operation is referred to as suction wiping. The elastic tube 40*a* is a tube-like member used for performing suction of a recording liquid from the ejection orifices 9 and wiping of the ejection orifice forming-face 11*a* with the edge thereof and is a type of wiping member. By performing suction wiping, it is possible to suck and remove dust attached to the entire ejection orifice forming-face 11*a* including a part near the ejection orifice 9, a solidified and attached recording liquid, a bubble present inside the ejection orifice 9 and the pressure chamber 14, a thickened recording liquid, and the like. The cleaning mechanism 30 having such a configuration may also be referred to as a vacuum wiper.

When suction wiping is performed by the vacuum wiper 30, different colors or types of recording liquids sucked from the ejection orifices 9 are mixed at or near a contact portion between the vacuum wiper 30 and the ejection orifice forming-member 11. A part of the recording liquid mixed in such a way (which may also be referred to as a color-mixed recording liquid) may enter the pressure chambers 14 from the ejection orifices 9. If the recording liquid is circulated without the color-mixed recording liquid being discharged from the ejection orifices 9 and the pressure chambers 14, the color-mixed recording liquid flows out to the liquid collection channel 17 and spreads in the entire circulation path of the recording liquid. Occurrence of such color mixture causes inability of reproducing an originally intended color and a reduction in print quality and thus has to be avoided. Conventionally, circulation of a recording liquid is stopped during wiping, preliminary ejection is performed after the end of wiping, the color-mixed recording liquid is discharged, and the circulation of the recording liquid is then resumed. The preliminary ejection is an operation to perform liquid ejection which does not contribute to recording before performing recording on a recording medium that is originally intended. Wiping takes time, and in particular, it takes a long time for wiping of the line type liquid ejection head 3. Thus, volatilization (evaporation) of a volatile component (for example, water) contained in the recording liquid proceeds at the ejection orifice 9 where suction wiping has been performed at the beginning of a wiping step, and the viscosity of the recording liquid near that ejection orifice 9 or inside the pressure chamber 14 will increase. Once the viscosity of the recording liquid increases, the thickened recording liquid is unable to be ejected to the outside (causes a liquid ejection failure) even if the recording element 15 is driven to generate energy. In particular, a recording liquid in commercial printing or the like often has the composition whose water content is less than 71%, and use of such a recording liquid exhibits a significant tendency to facilitate thickening. Such a tendency is more significant when the water content of a recording liquid is less than 66%, and the tendency is much more significant when the water content of a recording liquid is less than 60%. Further, the tendency towards thickening is significant also when the content of a solid component dispersed in a recording liquid is greater than or equal to 7%, and the tendency is more significant when the content of a solid component is greater than or equal to 10%.

Figure 6A:
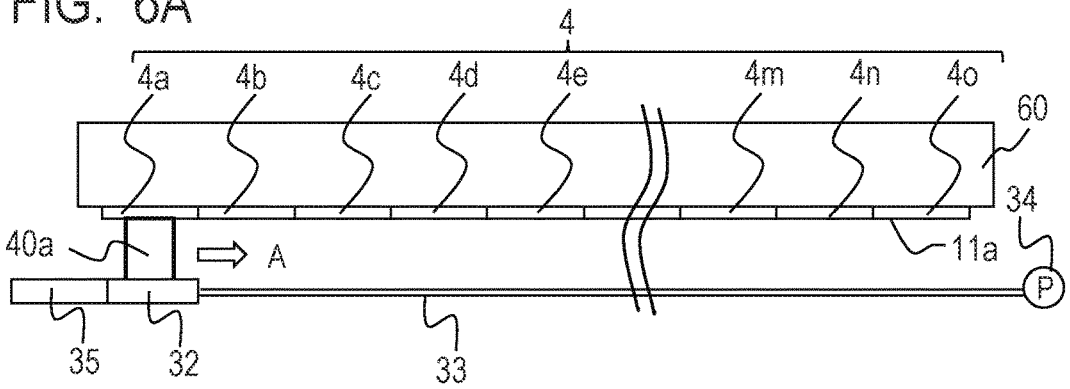
FIG. 6A, FIG. 6B, FIG. 6C, FIG. 6D, FIG. 6E, and FIG. 6F are schematic front views sequentially illustrating respective steps of the cleaning method of the liquid ejection head of the first embodiment of the present disclosure.
Figure 6B:
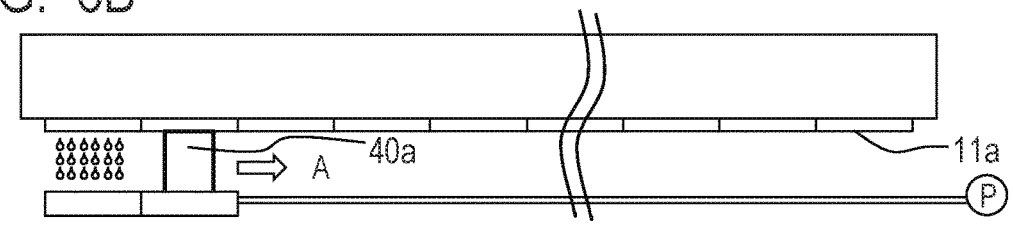
Figure 6C:
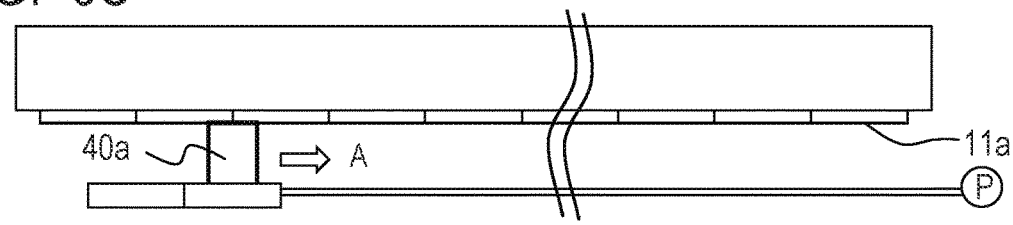
Figure 6D:
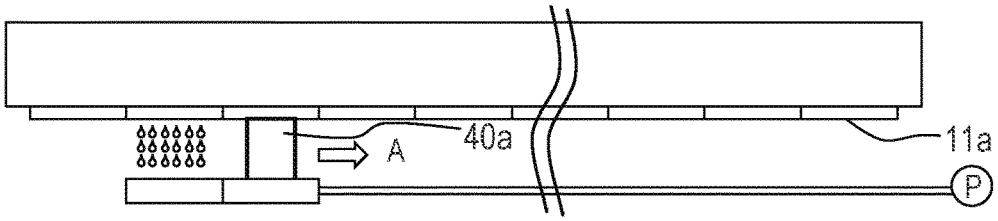
Figure 6E:
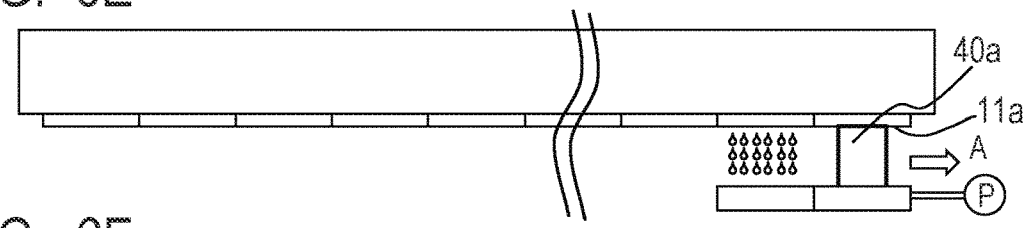
Figure 6F:
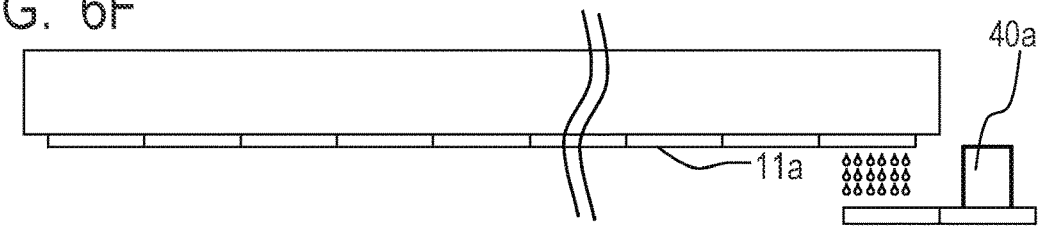

Accordingly, in the present embodiment, as illustrated in FIG. 6A to FIG. 6F, preliminary ejection is sequentially performed from a portion where the vacuum wiper 30 has passed without waiting for completion of wiping of the entire ejection orifice forming-face 11*a* over the plurality of recording element substrates 4*a* to 4*o* of the liquid ejection head 3. With this preliminary ejection step, the recording liquid is discharged to the outside from the ejection orifices 9 before the volatile component of the color-mixed recording liquid volatilizes, the viscosity of the recording liquid near the ejection orifices 9 or inside the pressure chambers 14 increases, and ejection of a liquid becomes difficult. That is, preliminary ejection is performed before a liquid ejection failure occurs due to an increase in the viscosity of a recording liquid at the already wiped ejection orifices 9. An example of specific timings of such wiping and preliminary ejection will be described below in order. Before wiping and preliminary ejection operations are performed, a circulation operation of a recording liquid is stopped. Then, as illustrated in FIG. 6A, the elastic tube 40*a* of the vacuum wiper 30 starts a wiping step to slidably contact with and suck the first recording element substrate 4*a* of the liquid ejection head 3. Subsequently, the vacuum wiper 30 moves in the A-direction, and the elastic tube 40*a* passes by the recording element substrate 4*a*. The vacuum wiper 30 then reaches a position illustrated in FIG. 6B, that is, a position where the elastic tube 40*a* faces the second recording element substrate 4*b* and, while slidably contacting with and sucking the recording element substrate 4*b*, starts a preliminary ejection step from the first recording element substrate 4*a*. Accordingly, the color-mixed recording liquid is drained to the preliminary ejection receiving part 35 from a part of the recording element substrate 4*a* near the ejection orifices 9 or inside the pressure chambers 14. After the wiping step of the second recording element substrate 4*b* and the preliminary ejection step at the first recording element substrate 4*a* end, the vacuum wiper 30 further moves in the A-direction as illustrated in FIG. 6C. As illustrated in FIG. 6D, the vacuum wiper 30 reaches a position where the elastic tube 40*a* faces the third recording element substrate 4*c*. The elastic tube 40*a* then slidably contacts with and sucks the third recording element substrate 4*c* and performs preliminary ejection at the second recording element substrate 4*b*. In such a way, suction wiping of a recording element substrate and preliminary ejection at a recording element substrate on which suction wiping has been performed are performed in parallel. As illustrated in FIG. 6E, the elastic tube 40*a* reaches the final recording element substrate 4*o* of the liquid ejection head 3, slidably contacts with and sucks the recording element substrate 4*o*, and performs preliminary ejection at the previous (upstream) recording element substrate 4*n*. Then, as illustrated in FIG. 6F, the elastic tube 40*a* further moves and passes by the final recording element substrate 4*o* of the liquid ejection head 3 and performs preliminary ejection at the final recording element substrate 4*o*. In such a way, suction wiping and preliminary ejection are performed on all the recording element substrates 4*a* to 4*o* of the liquid ejection head 3, and thereby the cleaning operation of the liquid ejection head 3 of the present embodiment is implemented. In the present embodiment, as illustrated in FIG. 6A to FIG. 6F, preliminary ejection is sequentially performed from a recording element substrate on which the elastic tube 40*a* has passed without waiting for completion of suction wiping of the entire ejection orifice forming-face 11*a* of the liquid ejection head 3. Accordingly, it is possible to discharge a color-mixed recording liquid to the outside from the ejection orifices 9 before the volatile component of the color-mixed recording liquid evaporates and the viscosity of the recording liquid near the ejection orifices 9 or inside the pressure chambers 14 increases. After completion of this cleaning operation of the liquid ejection head 3, that is, after completion of the preliminary ejection step, a recording liquid is supplied from the supply port 18*a* to each pressure chamber 14, and the recording liquid is collected from the pressure chamber 14 via the collection port 18*b*. In such a way, a circulation flow of a recording liquid is started to prepare the next recording.

Figure 7A:
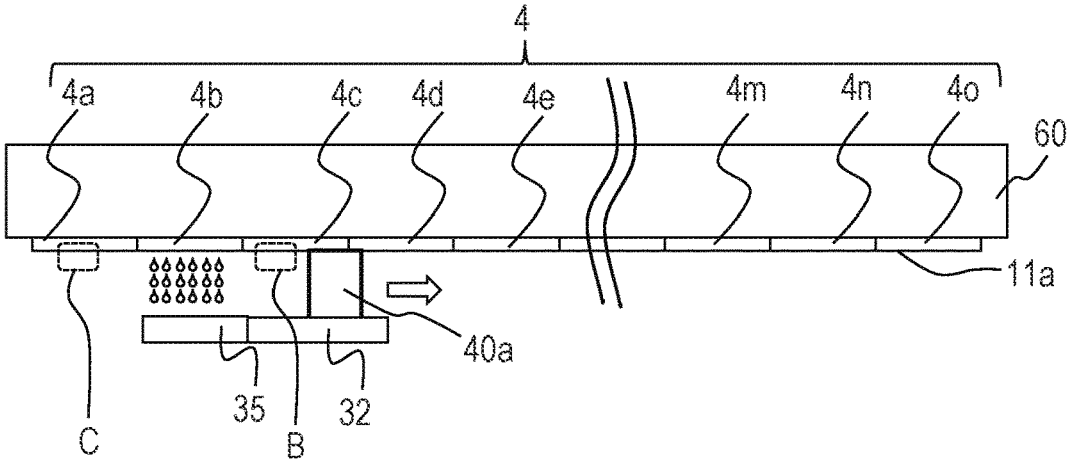
FIG. 7A is a schematic front view illustrating a part of the cleaning method of the liquid ejection head of the first embodiment of the present disclosure.
Figure 7B:
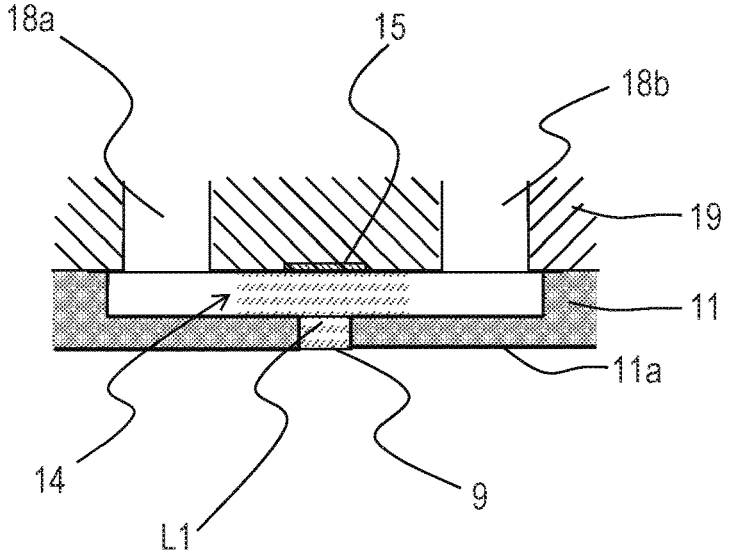
FIG. 7B is an enlarged sectional view illustrating a region B of FIG. 7A.
Figure 7C:
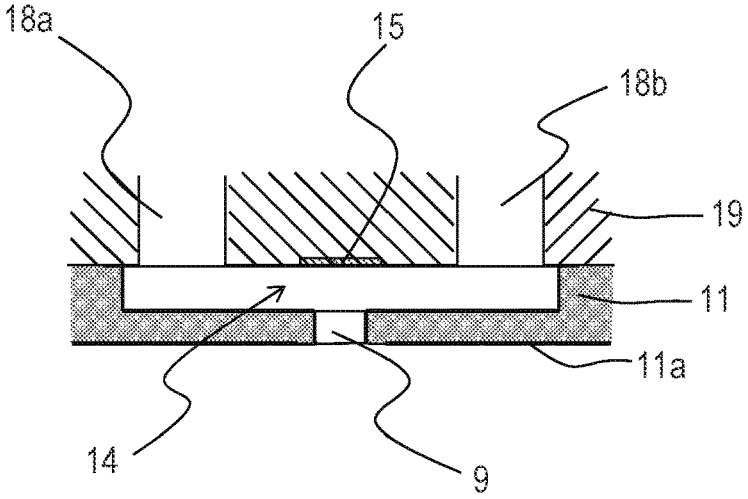
FIG. 7C is an enlarged sectional view illustrating a region C of FIG. 7A.
Figure 8A:
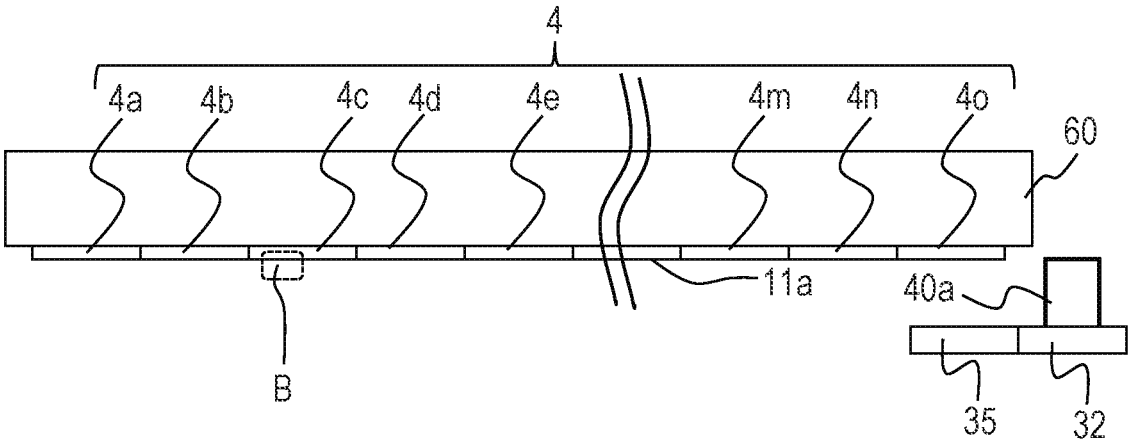
FIG. 8A is a schematic front view illustrating a part of the cleaning method of a liquid ejection head of the first embodiment of the present disclosure.
Figure 8B:
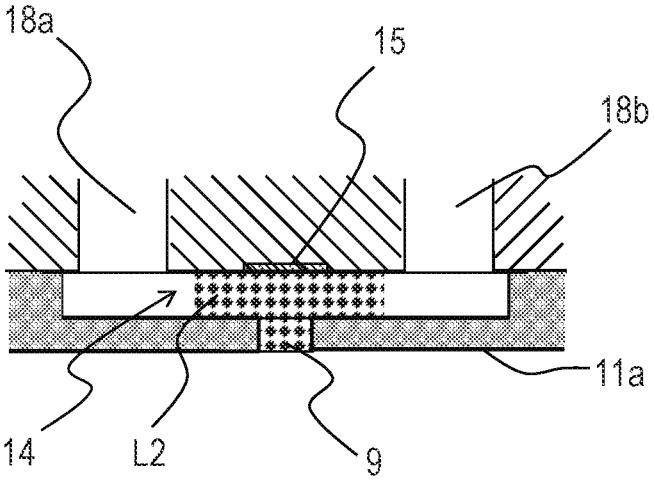
FIG. 8B is an enlarged sectional view illustrating a region B of FIG. 8A.
Figure 9A:
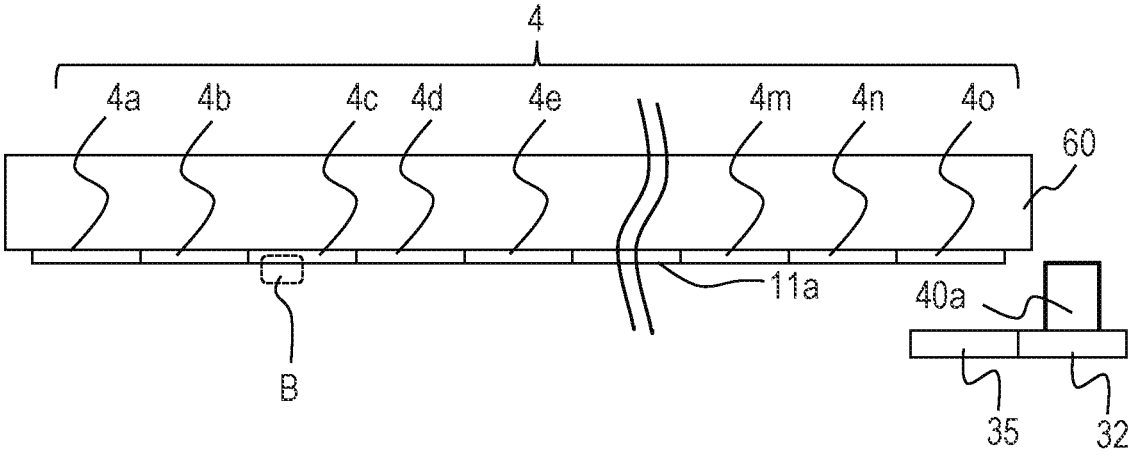
FIG. 9A is a schematic front view illustrating a liquid circulation state after the cleaning method of a liquid ejection head of the first embodiment of the present disclosure.
Figure 9B:
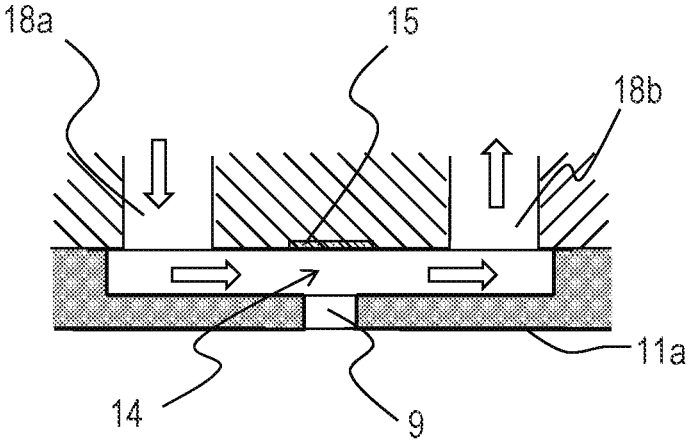
FIG. 9B is an enlarged sectional view illustrating a region B of FIG. 9A.

FIG. 7A to FIG. 9B are diagrams mainly illustrating states of periphery of the ejection orifice 9 or the pressure chamber 14. FIG. 7A is a front view illustrating a state after the state illustrated in FIG. 6D, that is, a state where suction wiping of a part of the third recording element substrate 4*c* is completed and preliminary ejection at the second recording element substrate 4*b* is being performed. FIG. 7B is an enlarged sectional view of a region B part of FIG. 7A, which is a sectional view illustrating a main part of a state before preliminary ejection is performed after suction wiping is completed for the third recording element substrate 4*c*. FIG. 7C is an enlarged sectional view of the region C part of FIG. 7A, which is a sectional view illustrating a main part of the first recording element substrate 4*a* on which suction wiping and preliminary ejection are completed. FIG. 8A is a front view illustrating a state after the state illustrated in FIG. 6F, that is, a state where suction wiping and preliminary ejection of all the recording element substrates 4*a* to 4*o* are completed. FIG. 8B is an enlarged sectional view of the region B part of FIG. 8A, which is a sectional view illustrating a main part of the third recording element substrate 4*c* left unprocessed after suction wiping and preliminary ejection are completed. FIG. 9A is a front view illustrating a state after the state illustrated in FIG. 8A, that is, a state where circulation of a recording liquid is started after suction wiping and preliminary ejection for all the recording element substrates 4*a* to 4*o* are completed. FIG. 9B is an enlarged sectional view of the region B part of FIG. 9A, which is a sectional view illustrating a main part of the third recording element substrate 4*c* where circulation of a recording liquid is started.

As schematically illustrated in FIG. 7B, in a state where suction wiping is completed but preliminary ejection has not been performed, a color-mixed recording liquid L1 is present in the ejection orifice 9 and the pressure chamber 14. In the present disclosure, preliminary ejection is immediately performed without the state being left unprocessed, that is, without waiting for completion of suction wiping of all the recording element substrates 4*a* to 4*o* of the liquid ejection head 3. As a result, in the same manner as in the state illustrated in FIG. 7C, the color-mixed recording liquid L1 is discharged to the outside, and no color-mixed recording liquid L1 is present around the ejection orifice 9 or the pressure chamber 14. When this state is left unprocessed until preliminary ejection at the final recording element substrate 4*o* of the liquid ejection head 3 is completed, the volatile component of the recording liquid evaporates from the ejection orifice 9 resulting in thickening. As schematically illustrated in FIG. 8B, this results in a state where a thickened recording liquid (condensed recording liquid) L2 is present in the ejection orifice 9 and the pressure chamber 14. Accordingly, circulation of the recording liquid is started, a fresh recording liquid is supplied from the supply port 18*a* to the pressure chamber 14 and the ejection orifice 9. The thickened recording liquid L2 flows from the ejection orifice 9 and the pressure chamber 14 to the collection port 18*b* and is diluted with the fresh recording liquid during this process, and the viscosity thereof decreases. Further, since the color-mixed recording liquid L1 has already been discharged to the outside from the ejection orifice by the preliminary ejection, circulation of a recording liquid does not cause a color-mixed recording liquid to flow from the pressure chamber 14 and the ejection orifice 9 to the collection port 18*b*. Therefore, as illustrated in FIG. 9B, a state where a recording liquid that is neither color-mixed nor thickened is present in the ejection orifice 9 and the pressure chamber 14 is resulted. According to the present embodiment, circulation of a recording liquid is started after a cleaning operation (wiping and preliminary ejection) is performed, thereby a recording liquid that is neither color-mixed nor thickened is present in the pressure chamber 14 and the ejection orifice 9, a recording liquid of a desired color can be ejected, and recording with good recording quality can be performed.

As described above, according to the present embodiment, the wiping member 40*a* is moved along an ejection orifice array to wipe a plurality of ejection orifice arrays by the wiping member 40*a*. Then, before wiping the entire ejection orifice forming-face 11*a* present over the plurality of recording element substrates 4 is completed, preliminary ejection is started from the already wiped ejection orifices 9. The wiping step and the preliminary ejection step are sequentially performed from the first recording element substrate 4*a* located at one end to the final recording element substrate 4*o* located at the other end of the array of the recording element substrates 4 in such a way. Before wiping the entire ejection orifice forming-face 11*a* over all the recording element substrates 4 is completed, preliminary ejection is started from the ejection orifices 9 of a recording element substrate located upstream from a recording element substrate undergoing wiping in the moving direction of the wiping member 40*a*. Accordingly, a recording liquid for maintenance is less consumed, maintenance that stops circulation of the recording liquid can be completed in a short time, a thickened recording liquid can be removed from pressure chambers, and a recording operation can be immediately resumed. Further, a problem of color mixture or thickening of a recording liquid ejected from the liquid ejection head 3 due to suction wiping or the like is solved, and good liquid ejection can be performed in the next recording. This method is preferable when the water content of the recording liquid is less than 71%, more preferable when the water content of the recording liquid is less than 66%, and particularly preferable when the water content of the recording liquid is less than 60%. Further, this method is preferable when the content of the solid component dispersed in the recording liquid is greater than or equal to 7% and more preferable when the content of the solid component is greater than or equal to 10%. Note that, although a recording element substrate undergoing wiping and a recording element substrate undergoing preliminary ejection are adjacent to each other in the moving direction of the wiping member in the present embodiment, the embodiment is not limited to such a configuration. The above operation control is mainly performed by the control mechanism 50 (see FIG. 16).

Second Embodiment

Figure 10:
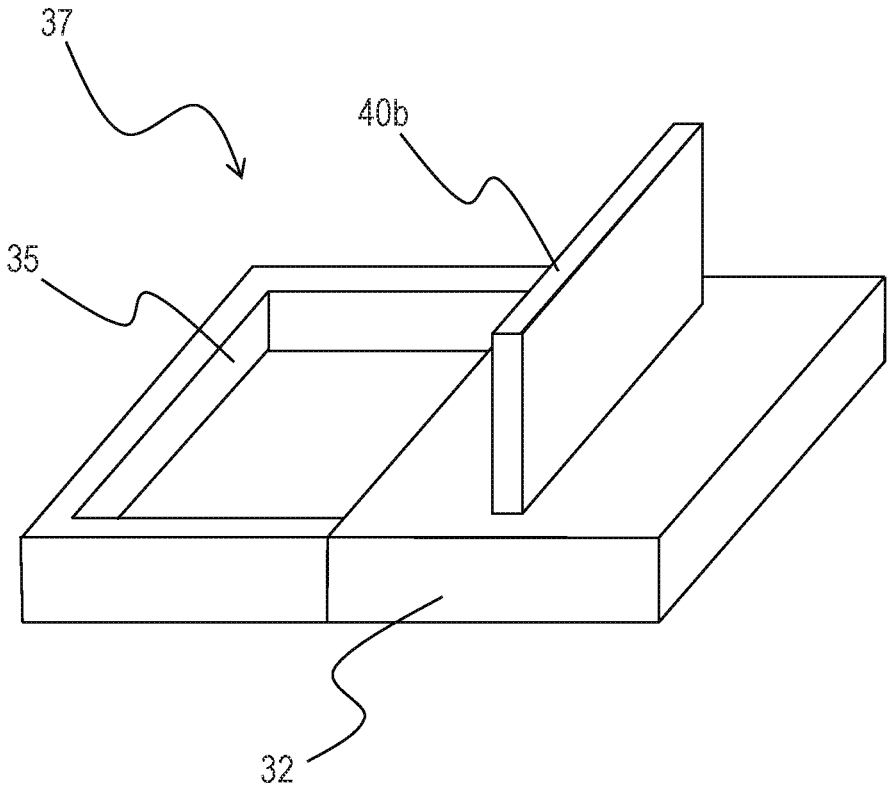
FIG. 10 is a schematic perspective view illustrating a cleaning mechanism of a liquid ejection head of a second embodiment of the present disclosure.

A second embodiment of the present disclosure will be described below. The same configuration and method as those in the first embodiment will be labeled with the same reference, and the description thereof may be omitted. A cleaning mechanism of the present embodiment illustrated in FIG. 10 includes a blade wiper 37 in which a rubber blade 40*b* is attached to the base 32. The preliminary ejection receiving part 35 is provided to the base 32 adjacent to the rubber blade 40*b*. The rubber blade 40*b* is a flexible plate-like member that wipes the ejection orifice forming-face 11*a* with the edge thereof and a type of wiping member. By pushing the rubber blade 40*b* illustrated in FIG. 10 against the recording element substrate 4 to be slidably contacted with the surface of the recording element substrate 4, it is possible to wipe off dust or a solidified recording liquid attached near the ejection orifice 9 (see FIG. 3). This cleaning mechanism is used to perform respective steps (wiping and preliminary ejection) of the cleaning method that are substantially the same as the steps illustrated in FIG. 6A to FIG. 6F and sequentially clean up the plurality of recording element substrates 4.

When wiping is performed by the rubber blade 40*b* of the blade wiper 37, different colors or types of recording liquids drawn from the ejection orifices 9 by surface tension and capillary force are mixed near a contact portion between the rubber blade 40*b* and the ejection orifice forming-face 11*a*. A part of the mixed recording liquids then enters the pressure chamber 14 from the ejection orifice 9. The recording liquid that has been mixed by wiping and entered the pressure chamber 14 is drained to the preliminary ejection receiving part 35 by preliminary ejection performed at the same timing as that in the first embodiment. That is, also in the present embodiment, a color-mixed recording liquid is discharged from the ejection orifices 9 by sequentially performing preliminary ejection from the recording element substrate 4 on which the rubber blade 40*b* has passed without waiting for completion of wiping of all the recording element substrates 4 of the liquid ejection head 3. Since no circulation of a recording liquid is being performed at this point of time, the color-mixed recording liquid does not flow out to the collection port 18*b* and can be discharged to the outside. Since preliminary ejection is performed immediately after wiping, the color-mixed recording liquid can be discharged to the outside from the ejection orifices 9 or the pressure chambers 14 before the volatile component of the color-mixed recording liquid evaporates and the recording liquid is thickened. Further, even when a recording liquid is left unprocessed after wiping and preliminary ejection and is thickened, circulation of a recording liquid is started and a fresh recording liquid is supplied before recording is started, the thickened recording liquid is caused to flow to the collection port 18*b* and diluted with the fresh recording liquid. Therefore, when liquid ejection is performed again, good recording quality is obtained. Further, a recording liquid for maintenance is less consumed, maintenance that stops circulation of the recording liquid can be completed in a short time, a thickened recording liquid can be removed from pressure chambers, and the recording operation can be immediately resumed.

Third Embodiment

Figure 11A:
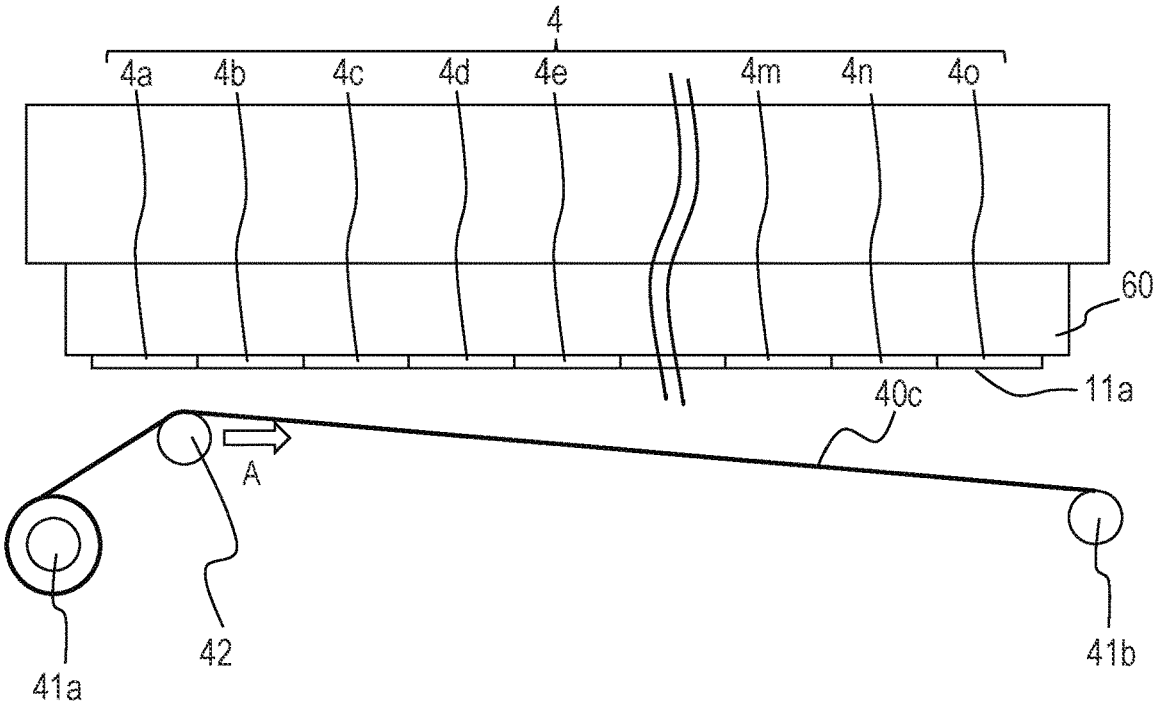
FIG. 11A is a schematic front view illustrating a cleaning mechanism of a liquid ejection head of a third embodiment of the present disclosure.
Figure 11B:
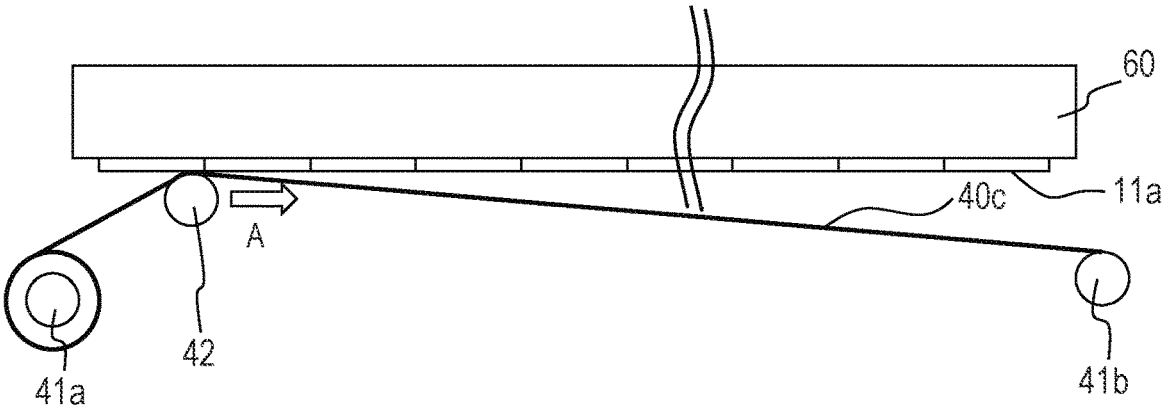
FIG. 11B and FIG. 11C are schematic front views sequentially illustrating respective steps of a cleaning method of the liquid ejection head according to the mechanism of FIG. 11A.
Figure 11C:
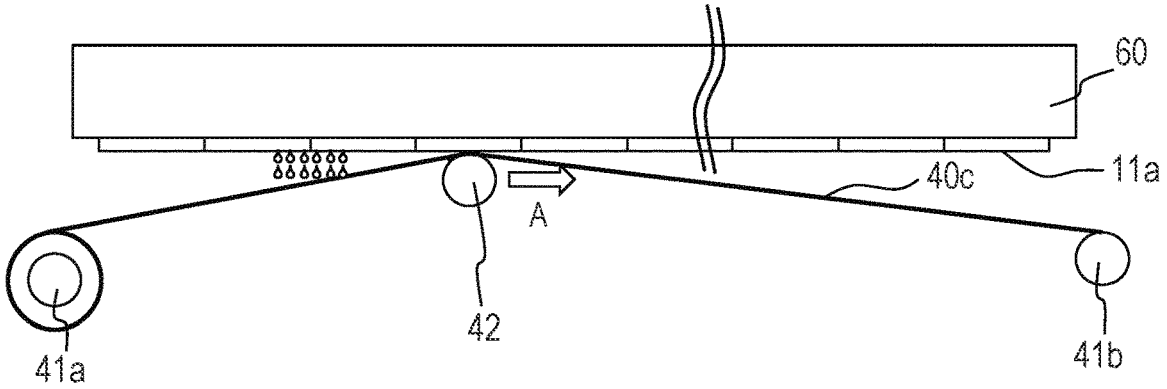

A third embodiment of the present disclosure will be described below. The same configuration and method as those in the first and second embodiments will be labeled with the same reference, and the description thereof may be omitted. A cleaning mechanism of the present embodiment illustrated in FIG. 11A is a wave wipe mechanism having a nonwoven fabric 40*c*, fixed rollers 41*a* and 41*b*, and a moving roller 42. The nonwoven fabric 40*c* is a liquid absorbing fabric member and is a type of wiping member. As illustrated in FIG. 11A, the nonwoven fabric 40*c* is wound around the fixed roller 41*a* and configured to be wound around the fixed roller 41*b* via the moving roller 42. When wiping is performed, as illustrated in FIG. 11A, the liquid ejection head and the cleaning mechanism are moved in advance so as to be located to face each other. Then, as illustrated in FIG. 11B, the moving roller 42 is pushed against the recording element substrate 4 and moved so as to roll on the surface of the recording element substrate 4. In such a way, by causing the nonwoven fabric 40*c* to rub the ejection orifice forming-face 11*a* of the ejection orifices 9, it is possible to remove dust or a solidified recording liquid attached near the ejection orifice 9. Then, as illustrated in FIG. 11C, it is possible to sequentially perform preliminary ejection onto the nonwoven fabric 40*c* from the recording element substrate 4 on which the moving roller 42 has passed without waiting for completion of wiping of all the recording element substrates 4 of the liquid ejection head 3. After the wiping and the preliminary ejection are performed on the entire ejection orifice forming-face 11*a*, the dirty nonwoven fabric 40*c* is wound around the fixed roller 41*b*, and a new portion of the nonwoven fabric 40*c* faces the ejection orifice forming-face 11*a* and is prepared for the next wiping operation.

Also in the present embodiment, a color-mixed recording liquid does not flow out to the collection port 18*b* and can be discharged to the outside. Since preliminary ejection is performed immediately after wiping, the color-mixed recording liquid can be discharged to the outside from the ejection orifices 9 or the pressure chambers 14 before the volatile component of the color-mixed recording liquid evaporates and the recording liquid is thickened. Further, even when a recording liquid is left unprocessed after wiping and preliminary ejection and is thickened, circulation or a recording liquid is started and a fresh recording liquid is supplied before recording is started, the thickened recording liquid is caused to flow to the collection port 18*b* and diluted with the fresh recording liquid. Therefore, when liquid ejection is performed again, good recording quality is obtained. Further, in the present embodiment, preliminary ejection can be performed directly onto the nonwoven fabric 40*c*, and it is not required to provide the preliminary ejection receiving part.

Note that, although the nonwoven fabric 40*c* is used as a wiping member in the present embodiment, a wiping member made of a liquid absorbing porous material (not illustrated), for example, can be used in terms of absorbing and collecting a recording liquid. When a porous material is used, the shape thereof may be a plate-like shape similar to the rubber blade 40*b* illustrated in FIG. 10 or may be a sheet-like shape similar to the nonwoven fabric 40*c* illustrated in FIG. 11A to FIG. 11C.

Fourth Embodiment

Figure 12A:
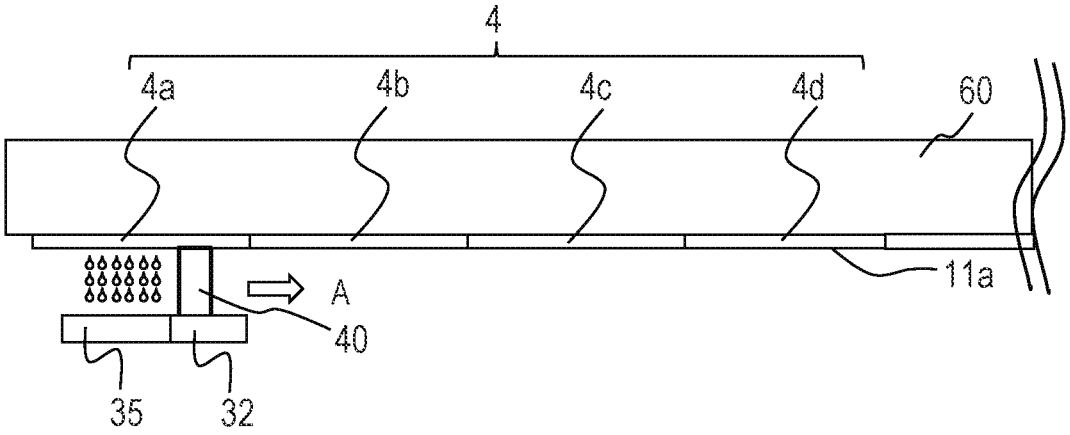
FIG. 12A, FIG. 12B, and FIG. 12C are schematic front views sequentially illustrating respective steps of a cleaning method performed by using a cleaning mechanism of a liquid ejection head of a fourth embodiment of the present disclosure.
Figure 12B:
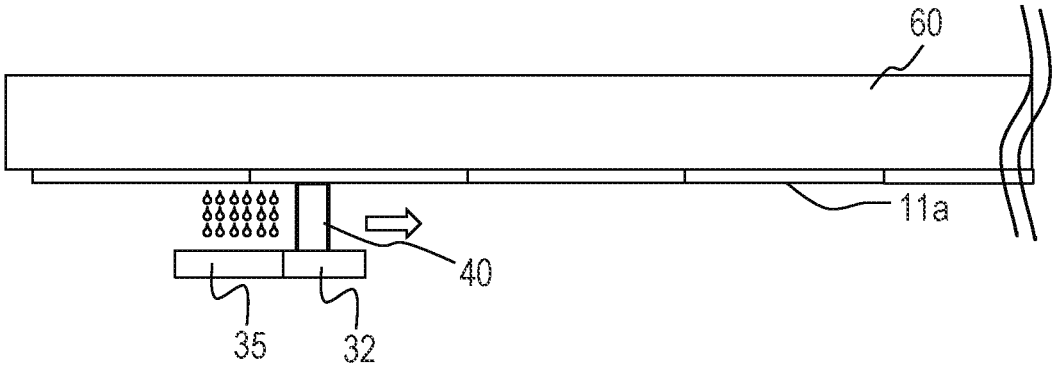
Figure 12C:
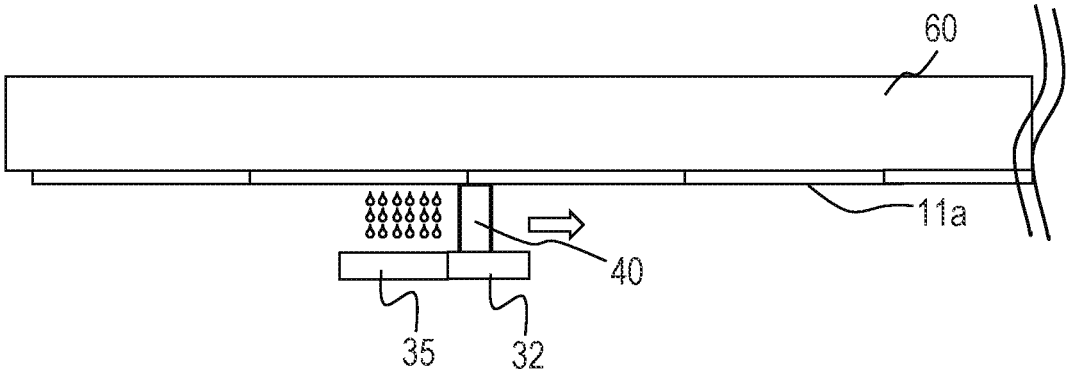

A fourth embodiment of the present disclosure will be described below. The same configuration and method as those in the first to third embodiments will be labeled with the same reference, and the description thereof may be omitted. In the first to third embodiments, preliminary ejection at a fully wiped recording element substrate is performed at a timing that the wiping member 40 is wiping the next recording element substrate after completely passing on one recording element substrate. The wiping member 40 as used herein is a general term including the elastic tube 40*a*, the rubber blade 40*b*, the nonwoven fabric 40*c*, the porous material, and the like described above. In contrast, in the present embodiment, as illustrated in FIG. 12A to FIG. 12C, preliminary ejection is sequentially performed from the ejection orifice 9 which is included in a single recording element substrate 4 and on which the wiping member 40 just passed. For example, as illustrated in FIG. 12A, while the first recording element substrate 4*a* is being wiped, preliminary ejection is performed at the ejection orifices 9 which are included in the recording element substrate 4*a* and on which the wiping member 40 has passed. As illustrated in FIG. 12B, while the wiping member 40 is wiping the next recording element substrate 4*b*, preliminary ejection of a recording liquid is performed from the ejection orifices 9 which are included in the recording element substrate 4*a* and on which the wiping member 40 has passed. At the same time, preliminary ejection of a recording liquid is performed also from the ejection orifice 9 on which the wiping member 40 has already passed of the recording element substrate 4*b* undergoing wiping. As illustrated in FIG. 12C, the wiping member 40 and the preliminary ejection receiving part 35 move from one end to the other end of the liquid ejection head 3. In response to completion of the cleaning operation for all the recording element substrates 4 of the liquid ejection head 3, circulation of the recording liquid is immediately resumed. That is, in the present embodiment, the timing of the start of liquid circulation after a cleaning operation is completed can be earlier. Further, the present embodiment can more promptly discharge a color-mixed recording liquid to the outside from the ejection orifices 9 and thus is suitable for a case of using a recording liquid that is more easily thickened.

In the first to third embodiments, each of the wiping members 40 and the preliminary ejection receiving part 35 has the same size as each recording element substrate 4 in a planar view. In contrast, in the present embodiment, each of the wiping members 40 and the preliminary ejection receiving part 35 may be smaller than each recording element substrate 4 in a planar view, or the assembly of the wiping member 40 and the preliminary ejection receiving part 35 may have a size that can be included in a single recording element substrate 4 in a planar view. Therefore, the cleaning mechanism can be reduced in size. The wiping member 40 of the present embodiment may be any of the same elastic tube 40*a* as that in the first embodiment, the same rubber blade 40*b* as that in the second embodiment, the same nonwoven fabric 40*c* or the porous material as those in the third embodiment, or the like.

Fifth Embodiment

Figure 13A:
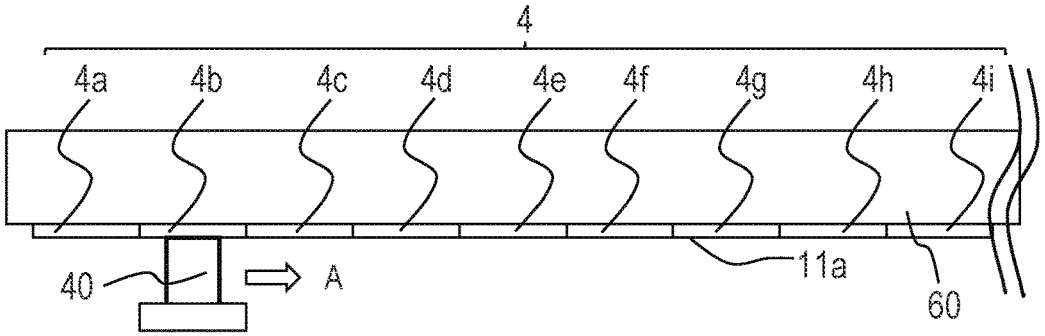
FIG. 13A, FIG. 13B, and FIG. 13C are schematic front views sequentially illustrating respective steps of a cleaning method performed by using a cleaning mechanism of a liquid ejection head of a fifth embodiment of the present disclosure.
Figure 13B:
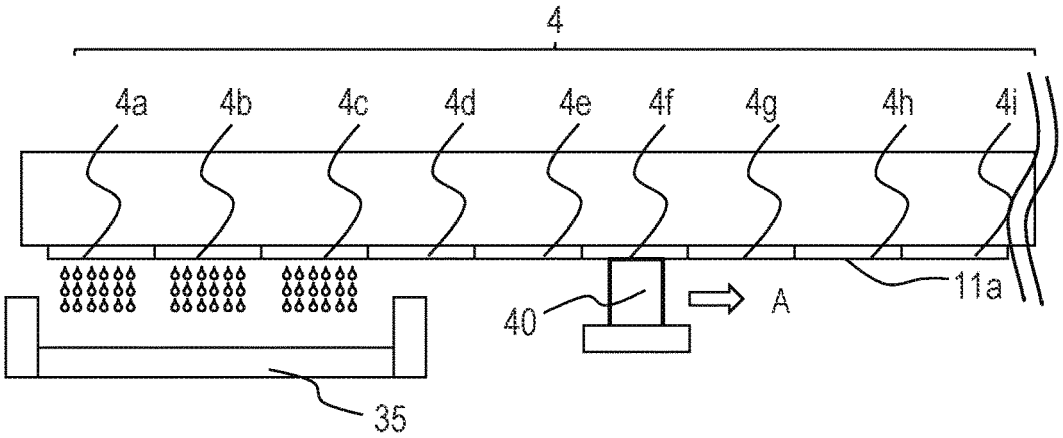

A fifth embodiment of the present disclosure will be described below. The same configuration and method as those in the first to fourth embodiments will be labeled with the same reference, and the description thereof may be omitted. In the present embodiment, the time period from completion of wiping to start of preliminary ejection is set to be the longest taking an evaporation characteristic of a recording liquid to be used into consideration. This enables the distance between the wiping member 40 and the preliminary ejection receiving part 35 to be larger than that in the first to fourth embodiments. It is therefore possible to use the preliminary ejection receiving part 35 having a large capacity and address a case of a large amount of the recording liquid discharged by preliminary ejection. In the present embodiment, as illustrated in FIG. 13A, the wiping member 40 sequentially performs the wiping operation (wiping) from the first recording element substrate 4*a*. Then, as illustrated in FIG. 13B, for example, at a point of time when the wiping member reaches the sixth recording element substrate 4*f*, preliminary ejection for three recording element substrates 4*a*, 4*b*, and 4*c* is performed, and the discharged recording liquid is collected by a large preliminary ejection receiving part 35.

Figure 14:
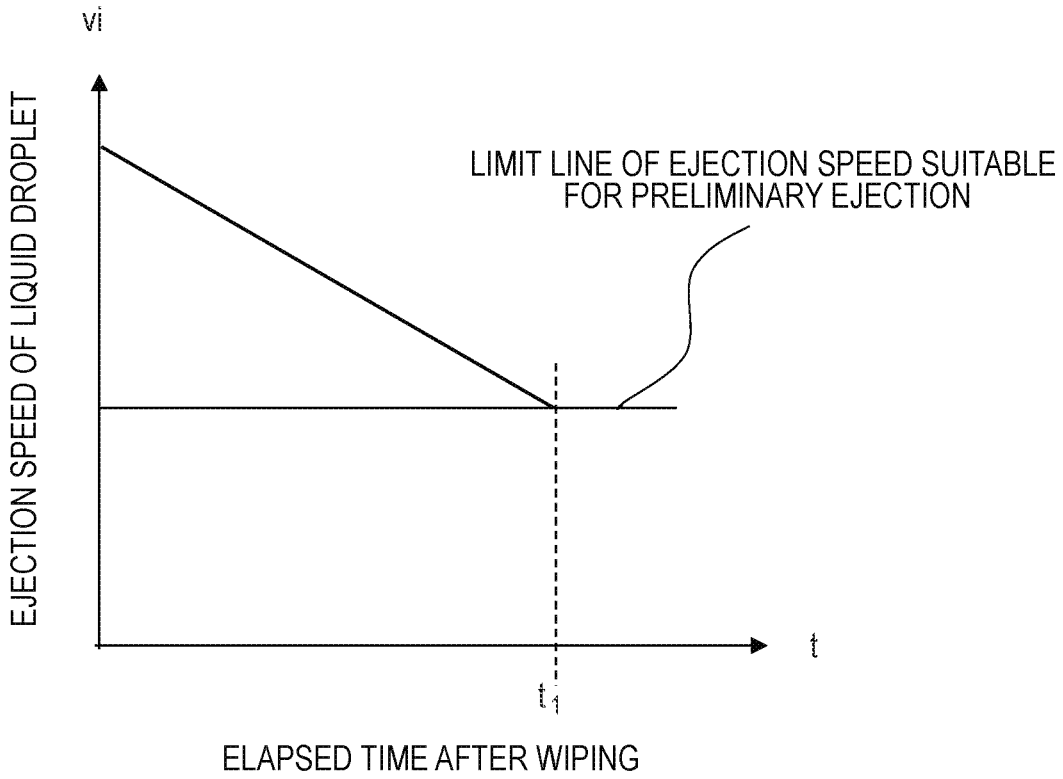
FIG. 14 is a graph illustration a relationship between elapsed time after completion of wiping and an ejection speed of a liquid droplet ejected from an ejection orifice.

The timing of the start of preliminary ejection from the ejection orifices 9 after wiping has been performed by the wiping member 40 is restricted by a thickening state of the recording liquid to be used, and the thickening state of the recording liquid is determined in accordance with characteristics of the recording liquid itself, an environmental condition, or the like. The time period from the end of wiping to start of preliminary ejection will be described below. FIG. 14 illustrates a relationship between the elapsed time t from completion of wiping and an ejection speed vi of a liquid droplet ejected from the ejection orifice 9. According to the relationship, while the liquid droplet ejection speed is high immediately after wiping, the ejection speed decreases as time elapses from the wiping because the recording liquid is thickened. Then, after a certain period of time elapses, the ejection speed suitable for discharging a color-mixed recording liquid by preliminary ejection is no longer obtained, and the color-mixed recording liquid is unable to be sufficiently discharged from the ejection orifice 9 and the pressure chamber 14. That is, a liquid ejection failure occurs. The time period before the lowest ejection speed at which a color-mixed recording liquid can be sufficiently discharged by preliminary ejection (limit line of the ejection speed) is reached after wiping is performed is denoted as t1. That is, at each ejection orifice 9, if preliminary ejection is performed at a timing before the time period t1 elapses after completion of wiping, the color-mixed thickened recording liquid can be discharged to the outside of the liquid ejection head 3.

Figure 13C:
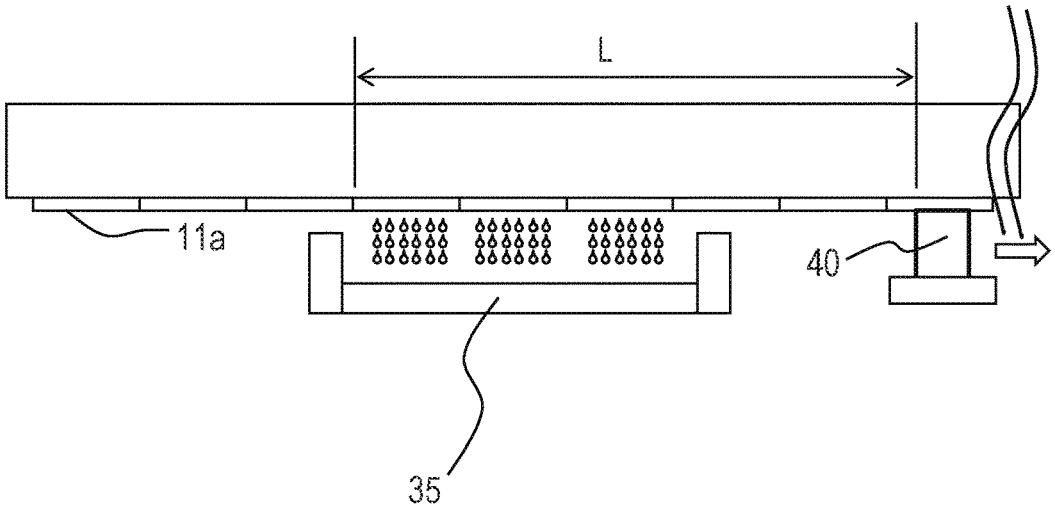

As described above, in the present embodiment, preliminary ejection is performed at a point of time when the time period t1 at the longest has elapsed after completion of wiping. At this time, the relative position of the preliminary ejection receiving part 35 that receives a preliminarily ejected liquid droplet with respect to the wiping member 40 is determined as follows. When the wiping member 40 moves at a moving speed vm, the maximum distance L (see FIG. 13C) from the position of the wiping member 40 to the position of the ejection orifice 9 at which preliminary ejection is performed at that timing is represented by the following equation.

$$L \leq vm \times t1 \quad \text{(Equation 1)}$$

Figure 15:
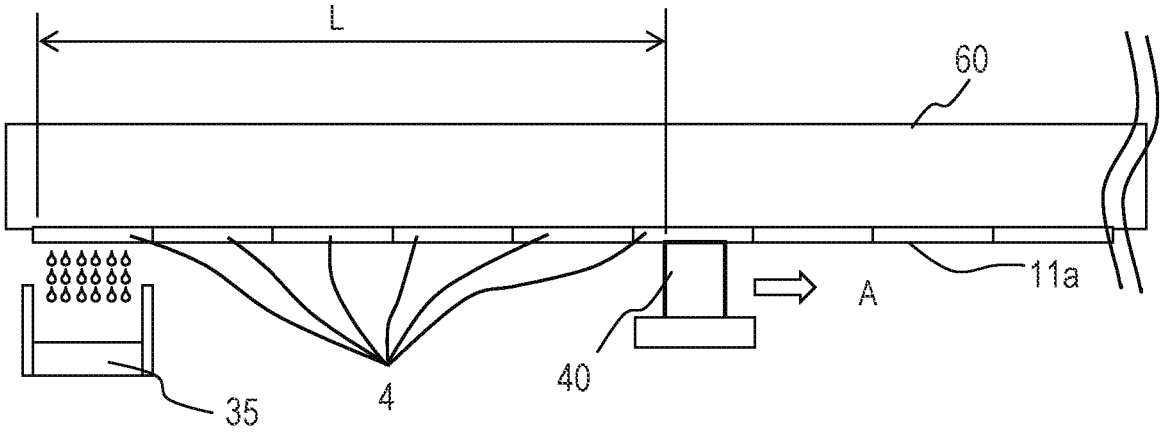
FIG. 15 is a schematic front view sequentially illustrating respective steps of a cleaning method performed by using a modified example of the cleaning mechanism of the liquid ejection head of the fifth embodiment of the present disclosure.

Therefore, configuration such that the preliminary ejection receiving part 35 is located in a range within a position that is at the distance L from the wiping member 40 is preferable. From another point of view, the position of the rear end of the preliminary ejection receiving part 35 that is subjected to preliminary ejection is arranged within a range of the distance L that satisfies Equation 1. Note that, since the time period t1 differs in accordance with the composition of the recording liquid or the surrounding environment (temperature and humidity) of the liquid ejection head, it is preferable to determine the time period t1 through a test under the most severe use environment condition that can be expected. For example, when the speed vm of the wiping member 40 is 20 mm/s and the limit time period t1 that enables good preliminary ejection is 1.5 seconds, this means L=vm×t1=30 mm. Therefore, the maximum distance between the wiping member 40 and the ejection orifice 9 at which preliminary ejection is performed at that timing is set to be 30 mm or shorter. That is, when the maximum distance from the wiping member 40 to the rear end of the preliminary ejection receiving part 35 is 30 mm and is included in the range of 30 mm or less from the wiping member 40, the preliminary ejection receiving part 35 can be increased in size. As long as this condition is satisfied, the preliminary ejection receiving part 35 having the same size as a single recording element substrate 4 may be arranged at a position that is at the distance L from the wiping member 40, as illustrated in FIG. 15, for example. In such a case, the preliminary ejection receiving part 35 is intermittently moved with a step size of the recording element substrate 4 as a unit of movement. This is a configuration to move the wiping member 40 and the preliminary ejection receiving part 35 independently of each other, and it is possible to adjust the distance L in accordance with characteristics of a recording liquid to be used and environmental conditions and move the wiping member 40 and the preliminary ejection receiving part 35 in accordance with the adjusted distance L.

Figure 16:
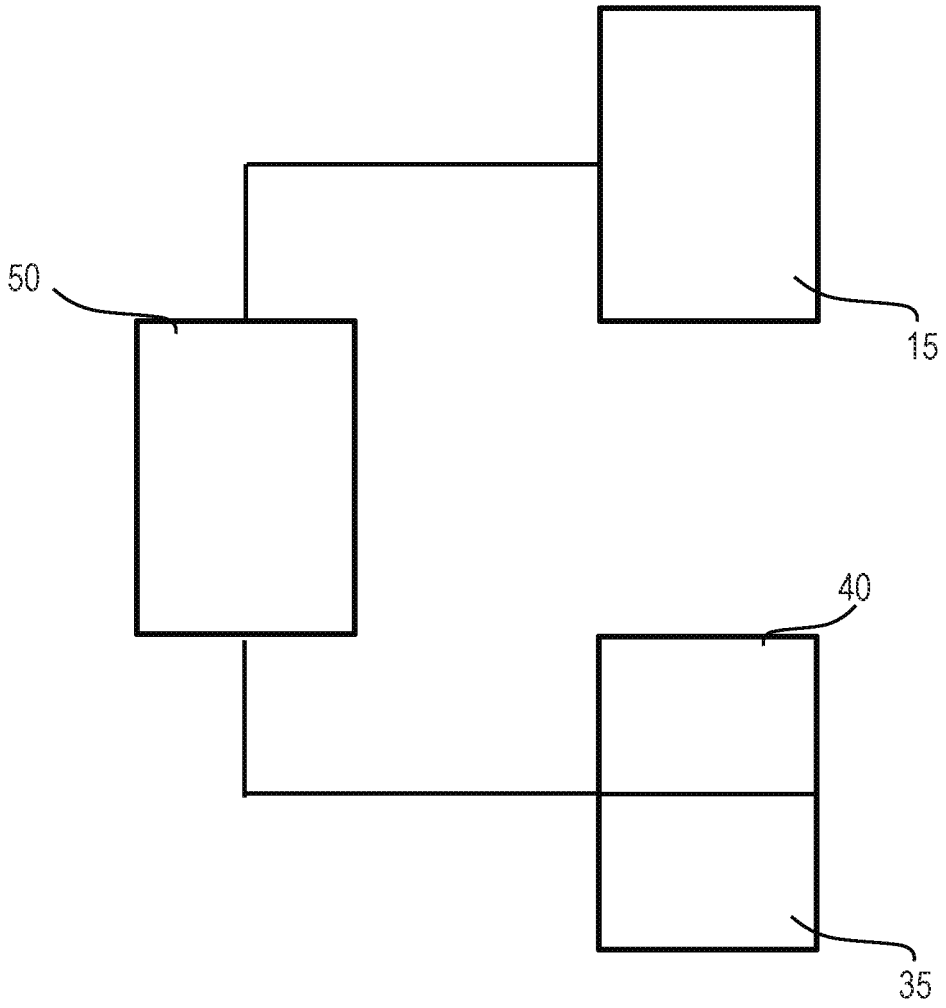
FIG. 16 is a block diagram schematically illustrating an example of a control system of a liquid ejection device to which the present disclosure is applied.

Various conditions in respective embodiments described above can be controlled by the control mechanism 50 provided to the body of the recording device 10 as illustrated in FIG. 16. The control mechanism 50 suitably controls the timing or the speed of the motion of the wiping member 40, the timing or the speed of the motion of the preliminary ejection receiving part 35, the region on which the recording element 15 is activated to perform liquid ejection (designation of the recording element substrate 4 on which preliminary ejection is performed), the ejection timing, or the like. In particular, control is provided so that the timing of preliminary ejection and the motion timing of the preliminary ejection receiving part are synchronized. That is, the control mechanism 50 causes the wiping member 40 to move along the ejection orifice array and simultaneously wipe a plurality of ejection orifice arrays. Before wiping of the entire ejection orifice forming-face 11*a* of the liquid ejection head 3 is completed, preliminary ejection of a recording liquid from the already wiped ejection orifices 9 is started. A liquid that was not used for recording and is preliminarily ejected by the preliminary ejection receiving part 35 is then sequentially collected in accordance with the order of being preliminarily ejected. Further, it is preferable to suitably control these conditions as long as Equation 1 described above in the fifth embodiment is satisfied. In such a way, motion of the wiping member 40 from one end to the other end of the liquid ejection head 3 is controlled to sequentially perform the cleaning operation. After the cleaning operation is completed, circulation of a recording liquid is immediately performed. The control mechanism 50 stops a circulation flow that causes a recording liquid to flow from the supply port 18*a* to the collection port 18*b* via the pressure chambers 14 during recording before performing wiping and preliminary ejection and, after completion of wiping and preliminary ejection of the recording liquid for all the ejection orifices 9, resumes the circulation flow. A recording operation to eject a recording liquid in accordance with input of a recording signal is then performed.

According to the cleaning method of the present disclosure, a recording liquid is sequentially ejected from ejection orifices 9 before wiping all the recording element substrates 4 of the liquid ejection head 3 is completed and before a color-mixed recording liquid pushed into the ejection orifices 9 and the pressure chambers 14 of the liquid ejection head 3 is thickened. Accordingly, a color-mixed recording liquid is not circulated, and no reduction in recording quality is caused in the subsequent liquid ejection. Note that the present disclosure can be widely applicable to a configuration in which at least one ejection orifice array ejects a different recording liquid than another ejection orifice array without being limited to the configuration in which all the ejection orifice arrays eject respective different colors or types of liquid. Further, the present disclosure can be applied to a configuration in which the liquid ejection head 3 has only one recording element substrate 4. In addition, a recording liquid for maintenance is less consumed, maintenance that stops circulation of the recording liquid can be completed in a short time, a thickened recording liquid can be removed from pressure chambers, and the recording operation can be immediately resumed. In the above illustration, application to the configuration of a multicolor integrated type line head has been described as the liquid ejection head. However, the cleaning method of the present disclosure is also applicable to the single-color line type liquid ejection head, for example, as a liquid ejection head employing a system to circulate a recording liquid. In such a case, while there is no problem of color mixture, it is possible to shorten the maintenance time. Further, it goes without saying that the cleaning method of the present disclosure is also applicable to a configuration to wipe a plurality of liquid ejection heads at once in a plurality of single-color line type liquid ejection heads each configured to eject different colors of liquids are arranged in parallel and color recording can be performed as a whole.

According to the present disclosure, it is possible to reduce consumption of a recording liquid for maintenance, complete maintenance, which stops circulation of the recording liquid, in a short time, remove a thickened recording liquid from pressure chambers, immediately resume the recording operation, and furthermore suppress color mixture, an ejection failure, or a reduction in recording quality.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-103054, filed Jun. 15, 2020, and Japanese Patent Application No. 2021-029159, filed Feb. 25, 2021, which are hereby incorporated by reference herein in their entirety.

What is claimed is:

1. A cleaning method of a liquid ejection head in which a plurality of recording element substrates are aligned, each of the recording element substrates has an ejection orifice forming-face in which a plurality of ejection orifice arrays are formed, each of the ejection orifice arrays comprises a plurality of ejection orifices, and at least one of the ejection orifice arrays ejects a different recording liquid than another one of the ejection orifice arrays, the cleaning method comprising:

a wiping step of performing wiping to wipe the ejection orifice forming-face; and a preliminary ejection step of performing preliminary ejection of the recording liquid from the wiped ejection orifices, wherein in the wiping step, a wiping member is moved along the ejection orifice arrays to wipe the plurality of ejection orifice arrays with the wiping member, wherein in the preliminary ejection step, before wiping of all ejection orifice forming-faces is completed, preliminary ejection from the wiped ejection orifices is started, and wherein the wiping step and the preliminary ejection step are sequentially performed from a recording element substrate located at one end to a recording element substrate located at the other end of an array of the recording element substrates.

2. The cleaning method of the liquid ejection head according to claim 1, wherein in the preliminary ejection step, before wiping of the entire all ejection orifice forming-face forming-faces of all the recording element substrates is completed, preliminary ejection from the ejection orifices of a recording element substrate located upstream from a recording element substrate undergoing wiping in a moving direction of the wiping member is started.

3. The cleaning method of the liquid ejection head according to claim 2, wherein the recording element substrate undergoing wiping and the recording element substrate undergoing preliminary ejection are adjacent to each other in the moving direction of the wiping member.

4. The cleaning method of the liquid ejection head according to claim 1, wherein a moving speed vm of the wiping member, a time period t1 from a time that wiping is performed to a time that a liquid ejection failure due to an increase in viscosity of the recording liquid occurs at the ejection orifices on which wiping was performed, and a distance L between the ejection orifices undergoing wiping and the ejection orifices at which preliminary ejection is started, satisfy a relationship of $L \leq vm \times t1$.

5. The cleaning method of the liquid ejection head according to claim 1, wherein in a case where a plurality of recording liquids, different from each other, ejected from the liquid ejection head, contain a volatile component, and where at least one of the recording liquids contains water as the volatile component, water content is less than 71%.

6. The cleaning method of the liquid ejection head according to claim 5, wherein the water content is less than 66%.

7. The cleaning method of the liquid ejection head according to claim 6, wherein the water content is less than 60%.

8. The cleaning method of the liquid ejection head according to claim 1, wherein in a case where at least one of a plurality of recording liquids, different from each other, ejected from the liquid ejection head, contains a solid component, a content of the solid component is greater than or equal to 7%.

9. The cleaning method of the liquid ejection head according to claim 8, wherein the content of the solid component is greater than or equal to 10%.

10. The cleaning method of the liquid ejection head according to claim 1, wherein the wiping member is a tube-like member, and suction of the recording liquid from the ejection orifices and wiping the ejection orifice forming-face with an edge of the tube-like member are performed.

11. The cleaning method of the liquid ejection head according to claim 1, wherein the wiping member is a flexible plate-like member, and wiping the ejection orifice forming-face with an edge of the plate-like member is performed.

12. The cleaning method of the liquid ejection head according to claim 1, wherein the wiping member is a liquid absorbing fabric member.

13. The cleaning method of the liquid ejection head according to claim 1, wherein the wiping member is a liquid absorbing porous material.

14. A control method of a liquid ejection head, the control method comprising:

the steps of the cleaning method of the liquid ejection head according to claim 1; and a step of circulating the recording liquid through a pressure chamber after completion of the steps of the cleaning method.

15. A liquid ejection device comprising:

a liquid ejection head in which a plurality of recording element substrates are aligned, each of the recording element substrates has an ejection orifice forming-face in which a plurality of ejection orifice arrays are formed, each of the ejection orifice arrays comprises a plurality of ejection orifices, and at least one of the ejection orifice arrays ejects a different recording liquid from a recording liquid ejected from another one of the ejection orifice arrays;

a wiping member that performs wiping of the ejection orifice forming-face;

a preliminary ejection receiving member that receives a liquid ejected by preliminary ejection from the ejection orifices after the wiping; and a control mechanism that controls operations of the liquid recording head, the wiping member, and the preliminary ejection receiving member, wherein the control mechanism is configured to perform control to move the wiping member along the ejection orifice arrays to wipe the plurality of ejection orifice arrays and at the same time, start preliminary ejection of the recording liquid from the wiped ejection orifices before wiping of all the ejection orifice forming-faces of the liquid ejection head is completed, and sequentially collect a liquid by the preliminary ejection receiving member in accordance with an order of preliminary ejection, the liquid being preliminarily ejected and not used for recording.

16. The liquid ejection device according to claim 15, wherein the control mechanism is configured to control the wiping member to sequentially perform wiping while moving from a recording element substrate located at one end to a recording element substrate located at the other end of an array of the recording element substrates and control the liquid ejection head to sequentially perform preliminary ejection of the recording liquid from the ejection orifices from the recording element substrate located at the one end to the recording element substrate located at the other end.

17. The liquid ejection device according to claim 15, wherein each of the recording element substrates comprises the plurality of ejection orifice arrays, a plurality of pressure chambers communicating with the ejection orifices, respectively, a plurality of energy-generating elements that are arranged in association with the pressure chambers and which generate energy for ejecting a recording liquid, supply ports that supply the recording liquid to the pressure chambers, and collection ports that collect the recording liquid from the pressure chambers, and wherein the control mechanism is configured to stop a circulation flow, that causes the recording liquid to flow from the supply ports to the collection ports via the pressure chambers during recording, before performing wiping and preliminary ejection and resume the circulation flow after completion of wiping and preliminary ejection of the recording liquid for all the ejection orifices.

* * * * *